US006568668B1

(12) United States Patent
Wakabayashi et al.

(10) Patent No.: US 6,568,668 B1
(45) Date of Patent: May 27, 2003

(54) SHEET FINISHER AND IMAGE FORMING APPARATUS THEREWITH

(75) Inventors: Hiroyuki Wakabayashi, Hachioji (JP); Masato Hattori, Hachioji (JP); Teruhiko Toyoizumi, Hachioji (JP); Masaru Ohtsuka, Hachioji (JP); Tetsuhiro Kodera, Hachioji (JP); Kohji Yoshie, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/430,343

(22) Filed: Oct. 29, 1999

(30) Foreign Application Priority Data

Nov. 10, 1998 (JP) ..... 10-318975

(51) Int. Cl.[7] ..... B65H 33/04

(52) U.S. Cl. ..... 270/58.11; 270/18; 270/37; 270/58.08; 270/58.07; 493/442; 493/443; 493/454; 493/405; 493/419

(58) Field of Search ..... 270/58.08, 58.11, 270/58.12, 58.07, 37, 18; 493/419–21, 442, 443, 454, 405, 23

(56) References Cited

U.S. PATENT DOCUMENTS

| | | | | | |
|---|---|---|---|---|---|
| 2,080,505 | A | * | 5/1937 | Rader et al. | 493/23 |
| 3,110,488 | A | * | 11/1963 | Whitecar | 493/23 |
| 4,077,078 | A | * | 3/1978 | Snellman et al. | 412/4 |
| 4,473,425 | A | * | 9/1984 | Baughman et al. | 156/356 |
| 4,586,640 | A | * | 5/1986 | Smith | 227/14 |
| 4,611,741 | A | * | 9/1986 | Wilson | 227/99 |
| 4,731,047 | A | * | 3/1988 | Lobb | 493/10 |
| 4,797,048 | A | * | 1/1989 | Doery | 412/11 |
| 4,989,852 | A | * | 2/1991 | Gunther, Jr. | 270/56 |
| 5,080,370 | A | * | 1/1992 | Hacknauer et al. | 270/37 |
| 5,090,671 | A | * | 2/1992 | Gombault et al. | 270/45 |
| 5,108,081 | A | * | 4/1992 | Russel et al. | 270/37 |
| 5,125,633 | A | * | 6/1992 | Fecker et al. | 270/45 |
| 5,196,083 | A | * | 3/1993 | Baker et al. | 156/362 |
| 5,201,503 | A | * | 4/1993 | Matsui et al. | 270/58.14 |
| 5,213,317 | A | * | 5/1993 | Mandel et al. | 270/58.11 |
| 5,320,336 | A | * | 6/1994 | Asami | 270/58.08 |
| 5,362,200 | A | * | 11/1994 | Ushirogata | 414/791 |
| 5,382,011 | A | * | 1/1995 | Tani | 270/37 |
| 5,570,985 | A | * | 11/1996 | Latvakangas et al. | 412/4 |
| 5,632,587 | A | * | 5/1997 | Coyette | 412/11 |
| 5,765,824 | A | * | 6/1998 | Kawano et al. | 270/58.11 |
| 5,881,352 | A | * | 3/1999 | Kobayashi et al. | 399/408 |
| 5,931,460 | A | * | 8/1999 | Kadowaki et al. | 271/220 |
| 6,003,853 | A | * | 12/1999 | Nakazawa et al. | 270/58.11 |
| 6,022,011 | A | * | 2/2000 | Hirose | 270/37 |

FOREIGN PATENT DOCUMENTS

| | | |
|---|---|---|
| EP | 0498168 | 8/1992 |
| EP | 0781722 | 7/1997 |

OTHER PUBLICATIONS

Xerox Disclsoure Journal (1995), No. 3,pp.265–266 vol. 20, Paul N. Richards, "Method . . . Booklets".

* cited by examiner

*Primary Examiner*—Donald P. Walsh
*Assistant Examiner*—Jeffery A Shapiro
(74) *Attorney, Agent, or Firm*—Muserlian, Lucas and Mercanti

(57) ABSTRACT

A sheet finisher includes: a sheet stacking section on which sheets are stacked; a pair of folding rollers for pressing and conveying the sheets; a roller driving device for driving the pair of folding rollers; a protruding member which is protruded toward a nipping position of the pair of folding rollers to fold the sheets stacked on the sheet stacking section in two; and a protruding member driving device for driving the protruding member to protrude toward the nipping position. When the protruding member driving device drives the protruding member toward the nipping position, the roller driving device is suspended to drive the pair of folding rollers to be conveyed.

18 Claims, 15 Drawing Sheets

SHEET FINISHER AND IMAGE FORMING APPARATUS THEREWITH

BACKGROUND OF THE INVENTION

The present invention relates to a sheet finisher having functions to take successively in a sheet finisher the sheets ejected out of an image forming apparatus such as an electrophotographic copying machine, a printer and a facsimile machine after image forming, and to conduct finishing actions such as stapling and folding for the sheets and to eject to the sheet ejecting section.

As an apparatus to collate a plurality of recording sheets each having thereon a recorded image ejected out of an image forming apparatus and to staple them with a stapler for each number of copies, a sheet finisher called a finisher is used.

The finisher is connected to an image forming apparatus main body such as a copying machine or a printer in terms of functions, and is driven to operate, interlocking with a sequence of operations of copying or printing process.

Therefore, the image forming apparatus capable of conducting image forming process at high speed requires a finisher capable of conducting high speed processing which can fulfill its functions, conforming to the processing speed of the image forming apparatus.

Finishers like that explained above are already disclosed in Japanese TOKKAISHO Nos. 60-142359, 60-158463, 62-239169, 62-288002, 63-267667, Japanese TOKKAIHEI Nos. 2-276691, 8-319054, and Japanese TOKKOHEI No. 5-41991.

A bookbinding apparatus disclosed in Japanese TOKKAISHO No. 60-183459 is one wherein a cover supplying device is provided, and bookbinding finishing work such as punching or stapling is carried out after copy sheets and a cover are superposed.

Disclosed in Japanese TOKKAIHEI Nos. 6-72064, 7-187479 and 8-192951 represents a sheet finisher having a function of midway stapling.

(1) In the means to fold a bundle of sheets which is composed of a pair of folding rollers which fold a bundle of sheets in two by pressing the central portion of the bundle of sheets in the direction of the conveyance thereof and of a means to protrude a bundle of sheets which protrudes a creased portion of the bundle of sheets while moving toward the pressure contact position of the folding rollers, a bundle of sheets has been folded in two by the method wherein the tip portion of a protruding plate of a sheet bundle protruding means is advanced to the nipping position of rotating paired folding rollers so that a portion to be creased of a bundle of sheets is protruded to be nipped for double folding.

However, when feeding a portion to be creased of a bundle of sheets toward the nipping position of the rotating paired folding rollers, a sheet on the outermost layer of the bundle of sheets is brought into contact with an outer circumferential surface of the rotating folding roller, and then is dragged in by frictional force to be deviated relatively from a sheet in an inner layer, resulting in occurrence of sheet damage such as creases or a tear.

In particular, when one or both of folding rollers are made to be an elastic roller, frictional force between an outer circumferential surface of each roller and an outermost layer of the bundle of sheets is great, and sheet damage is frequently caused.

(2) Even in the course of feeding a portion to be creased of a bundle of sheets to the nipping position of the rotating paired folding rollers, an outermost layer is damaged by friction caused by relative movement between the outermost layer in the vicinity of the tip portion of the bundle of sheets which is moved by the advancement of the tip portion of a protruding plate of a bundle of sheets protruding means and an outer circumferential surface of the rotating folding roller.

When a protruding plate is retreated after the portion near the tip portion of a bundle of sheets passes the nipping position of the rotating paired folding rollers, the bundle of sheets is sometimes withdrawn by frictional force the bundle of sheets nipped between folding rollers and the protruding plate.

(3) When both of the paired pressing rollers are metal or hard rollers, a sliding noise is generated when these rollers rotate. Further, a noise collision between both pressing rollers is generated after the trailing end portion of the bundle of sheets has passed the nipping position of the pressing rollers.

(4) Each of the conventional paired folding rollers and paired pressing rollers is a combination of a driving roller and a driven roller, and a bundle of sheets is nipped between both rollers to be conveyed. When conveying a bundle of sheets, a driving roller is away from a driven roller, and the driven roller has no conveyance driving force because it is rotated through movement of a bundle of sheets, and conveyance straightness for a bundle of sheets can not be assured. When conveying a thick bundle of sheets, in particular, improper conveyance tends to be caused.

(5) A bundle of sheets folded in two by the paired folding rollers and a sheet bundle protruding means is ejected out after the crease portion of the bundle of sheets is formed surely by paired pressing rollers. The bundle of sheets passing through the folding rollers and pressing rollers has been guided by a guide means in the past.

However, a clearance between both rollers of the paired folding rollers and that between both rollers of the paired pressing rollers are variable depending on a thickness of the bundle of sheets which passes through the rollers while being nipped between them. In the conventional guide means, it is impossible to regulate a conveyance path in the upward direction between folding rollers and between pressing rollers to comply with variable thickness of a bundle of sheets. Therefore, the bundle of sheets is not guided in the pressing rollers properly, which results in a fear of occurrence of improper conveyance.

(6) A protruding plate of the aforesaid sheet bundle protruding means has been driven so that it may move linearly in the direction perpendicular to the conveyance direction for a bundle of sheets. However, a complicated mechanism is needed for the protruding plate which is longer than the crease portion of the bundle of sheets to move linearly in a smooth manner.

SUMMARY OF THE INVENTION

The invention has been achieved to solve the problems stated above in the folding processing, and thereby to provide sheet finishers having the following structures.

(1) A sheet finisher having therein a sheet stacking section on which sheets are stacked, paired folding rollers which presses and conveys the sheets, a roller driving device which makes the paired folding rollers to be driven to convey, a protruding member which is protruded toward a pressure contact section of the folding rollers for folding double the sheets stacked on the sheet stacking section, and a protruding member driving device for protruding the protruding member toward the pressure contact section, wherein when the protruding member driving device protrudes the protruding member toward the pressure contact section, the roller driving device is suspended to drive the paired folding rollers to be conveyed.

(2) A sheet finisher having therein a sheet stacking section on which sheets are stacked, paired folding rollers which presses and conveys the sheets, a roller driving device for driving the paired folding rollers, a displacement mechanism which displaces each of the paired folding rollers in accordance with a thickness of a sheet, a protruding member which is protruded toward a pressure contact section of the folding rollers for folding double the sheets stacked on the sheet stacking section, a protruding member driving device for protruding the protruding member toward the pressure contact section, and a stopping member which stops each of the paired folding rollers so that the pressure contact section may be returned to the prescribed position for the protruding plate when each of the paired folding rollers is returned to its original position after being displaced.

(3) A sheet finisher having therein a sheet stacking section on which sheets are stacked, paired folding rollers which presses and conveys the sheets, a roller driving device which makes the paired folding rollers to be driven to convey, a displacement mechanism which displaces each of the paired folding rollers in accordance with a thickness of the sheets, a protruding member which is protruded toward a pressure contact section of the folding rollers for folding double the sheets stacked on the sheet stacking section, a protruding member driving device for protruding the protruding member toward the pressure contact section, and a stopping member which stops each of the paired folding rollers so that the pressure contact section may be returned to the prescribed position for the protruding member when each of the paired folding rollers is returned to its original position after being displaced, wherein when the protruding member driving device drives the protruding member toward the pressure contact section, the roller driving device is suspended to drive the paired folding rollers to be conveyed.

Further, preferable structures are as follows.

(Structure 1) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of at least a pair of folding rollers which press the central portion of the sheet bundle in the conveyance direction and fold the sheet bundle in two and of a sheet bundle protruding means which protrudes a portion to be folded on the sheet bundle while moving toward the pressure contact position of the folding rollers, the sheet bundle protruding means is provided with a protruding plate which comes in contact with the portion to be folded on the sheet bundle and protrudes it and with a driving means which drives the protruding plate, the tip portion of the protruding plate which comes in contact with the portion to be folded of the sheet bundle is moved by the driving means to the utmost insertion position which passes through the pressure contact position of the folding rollers to push in the portion to be folded of the sheet bundle, and the folding rollers keeps its non-rotation state until the tip portion of the protruding plate arrives at the utmost insertion position, and starts its rotation when the tip portion of the protruding plate arrives at the utmost insertion position.

(Structure 2) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of a pair of folding rollers which press the central portion of the sheet bundle in the conveyance direction and fold the sheet bundle in two and of a sheet bundle protruding means having a protruding plate which protrudes a portion to be folded on the sheet bundle while moving toward the pressure contact position of the folding rollers, and the paired folding rollers are supported to be capable of rotating in a way that the rollers are brought into pressure contact with each other by the urging means and are stopped by a stopping member arranged at the fixed position so that they may be close to each other or they may be brought into light contact with each other at the insertion position of the protruding plate.

(Structure 3) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of at least a pair of folding rollers which press the central portion of the sheet bundle in the conveyance direction and fold the sheet bundle in two and of a sheet bundle protruding means having a protruding plate which protrudes a portion to be folded on the sheet bundle while moving toward the pressure contact position of the folding rollers, a one-way clutch is provided on the drive transmission section which rotates the folding rollers, and the folding rollers are driven to rotate by the sheet bundle when the portion to be folded on the sheet bundle is protruded by the protruding plate to pass through the pressure contact position of the folding rollers while being brought into pressure contact.

(Structure 4) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of a pair of folding rollers which press the central portion of the sheet bundle in the conveyance direction and fold the sheet bundle in two, a sheet bundle protruding means which protrudes a portion to be folded on the sheet bundle while moving toward the pressure contact position of the folding rollers and of a pair of pressing rollers which are provided at the downstream side of the folding rollers in the sheet conveyance direction and press and convey the crease portion of the double-folded sheet bundle, the pressing rollers include a first roller whose surface is made of hard material and a second roller whose surface is made of elastic material, and aforesaid both rollers are brought into pressure contact with each other by an urging means.

(Structure 5) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of a pair of folding rollers which press the central portion of the sheet bundle in the conveyance direction and fold the sheet bundle in two, a sheet bundle protruding means which protrudes a portion to be folded on the sheet bundle while moving toward the pressure contact position of the folding rollers and of a pair of pressing rollers which are provided at the downstream side of the folding rollers in the sheet conveyance direction and press and convey the crease portion of the double-folded sheet bundle, and two rollers constituting the paired folding rollers and two rollers constituting the paired pressing rollers can be rotated by the driving force from the driving source.

(Structure 6) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of a pair of folding rollers which press the central portion of the sheet bundle in the conveyance direction and fold the sheet bundle in two, a sheet bundle protruding means which protrudes a portion to be folded on the sheet bundle while moving toward the pressure contact position of the folding rollers and of a pair of pressing rollers which are provided at the downstream side of the folding rollers in the sheet conveyance direction and press and convey the crease portion of the double-folded sheet bundle, and a first flat belt which is trained about a first roller constituting the paired folding rollers and a first roller constituting the paired pressing rollers and can be rotated, a second flat belt which is trained about a second roller constituting the paired folding rollers and a second roller constituting the paired pressing rollers and can be rotated, and an urging means which makes the first belt and the second belt to be in pressure contact with each other are provided, and the sheet bundle is nipped between the first flat belt and the second flat belt on a pressure contact basis to be conveyed.

(Structure 7) A sheet finisher having therein a first sheet stacking section capable of stacking plural sheets, a stapling means which staples sheets stacked on the first sheet stacking section, a second sheet stacking means which is provided at the downstream side of the first sheet stacking section in the sheet conveyance direction and stacks plural sheets subjected to the stapling processing, and a sheet bundle folding means which double-folds sheets stacked on the second sheet stacking means at the central portion in the sheet conveyance direction, wherein the sheet bundle folding means is composed of at least a pair of folding rollers which press the central portion of the sheet bundle in the conveyance direction and fold the sheet bundle in two and a sheet bundle protruding means which protrudes a portion to be folded on the sheet bundle while moving toward the pressure contact position of the folding rollers, the sheet bundle protruding means is equipped with a protruding plate which comes in contact with the portion to be folded of the sheet bundle to push it out and with a driving means to drive the protruding plate, and the protruding plate has a fulcrum for rotation at its one end in the direction perpendicular to the sheet conveyance direction, and is rotated by the driving means to protrude the portion to be folded of the sheet bundle to the pressure contact position of the folding roller.

(Structure 8)

An image forming apparatus equipped with the sheet finisher described in either one of the aforesaid Structures 1–7 above.

DETAILED DESCRIPTION OF THE PREFERRED EMBODIMENT

Next, an embodiment of the sheet finisher of the invention will be explained based on the drawings attached herewith.

Figure 1:
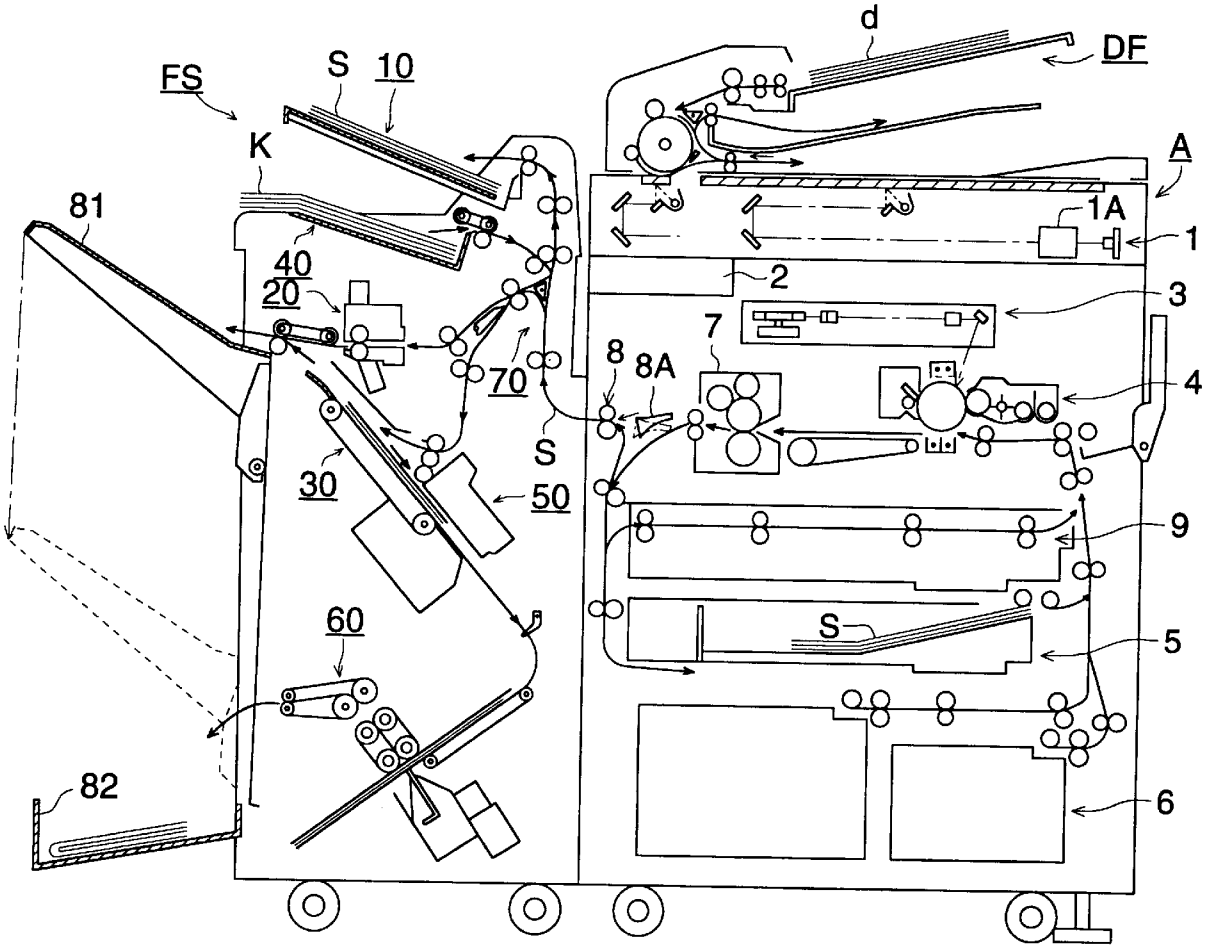
FIG. 1 is a total structure diagram of an image forming apparatus equipped with a sheet finisher and an automatic document feeder.

FIG. 1 is a total structure diagram of image forming apparatus A equipped with sheet finisher FS and automatic document feeder DF.

The illustrated image forming apparatus A is provided with image reading section 1, image processing section 2, image writing section 3, image forming section 4, cassette sheet feeding section 5, large capacity tray (LCT) 6, fixing unit 7, sheet ejection section 8, and automatic duplex unit (ADU) 9.

On the upper part of the image forming apparatus A, there is mounted automatic document feeder DF. On the part of sheet ejection section 8 on the illustrated left side of the image forming apparatus A, there is connected sheet finisher FS.

Document "d" placed on the document stand of the automatic document feeder DF is conveyed in the arrowed direction, and an image on one side of the document or images on both sides to the document are read by an optical system of image reading section (scanning exposure device) 1, and are read in CCD image sensor 1A.

Analog signals obtained through photoelectric conversion by CCD image sensor 1A are subjected to analog processing, A/D conversion, shading correction and image compression processing at image processing section 2, and signals are sent to image writing section 3.

In the image writing section 3, light outputted from a semiconductor laser is projected on a photoreceptor drum of image forming section 4, and a latent image is formed. In the image forming section 4, charging, exposure, developing, transfer, separation and cleaning are conducted, and an image is transferred onto recording sheet S fed out of cassette sheet feeding section 5 or large capacity tray 6. The recording sheet S carrying an image is fixed by fixing unit 7 and then is fed into sheet finisher FS from sheet ejection section 8. Or, recording sheet S whose one side has been finished in terms of image processing which has been fed into the automatic duplex unit 9 by conveyance path switching plate 8A is subjected to two-sided image processing at the image forming section 4 again, and is fed into the sheet finisher FS from the sheet ejection section 8.

On the sheet finisher FS, fixed sheet ejection tray 10, cover sheet feeding means 40, shift processing conveyance section (large capacity sheet ejection conveyance section) 20, first sheet stacking section (stacking means) 30, stapling means 50, and folding means 60 are arranged lengthwise almost in the vertical direction from the upper portion in the drawing.

On the upper portion on the right side on the illustration of the sheet finisher FS, there is arranged entrance conveyance section 70. On the left side on the illustration of the sheet finisher FS, there are arranged movable sheet ejection tray 81 receiving the sheet finished in terms of edge stapling and shift processing and fixed sheet ejection tray 82 receiving the sheet finished in terms of midway stapling and folding processing.

Figure 2:
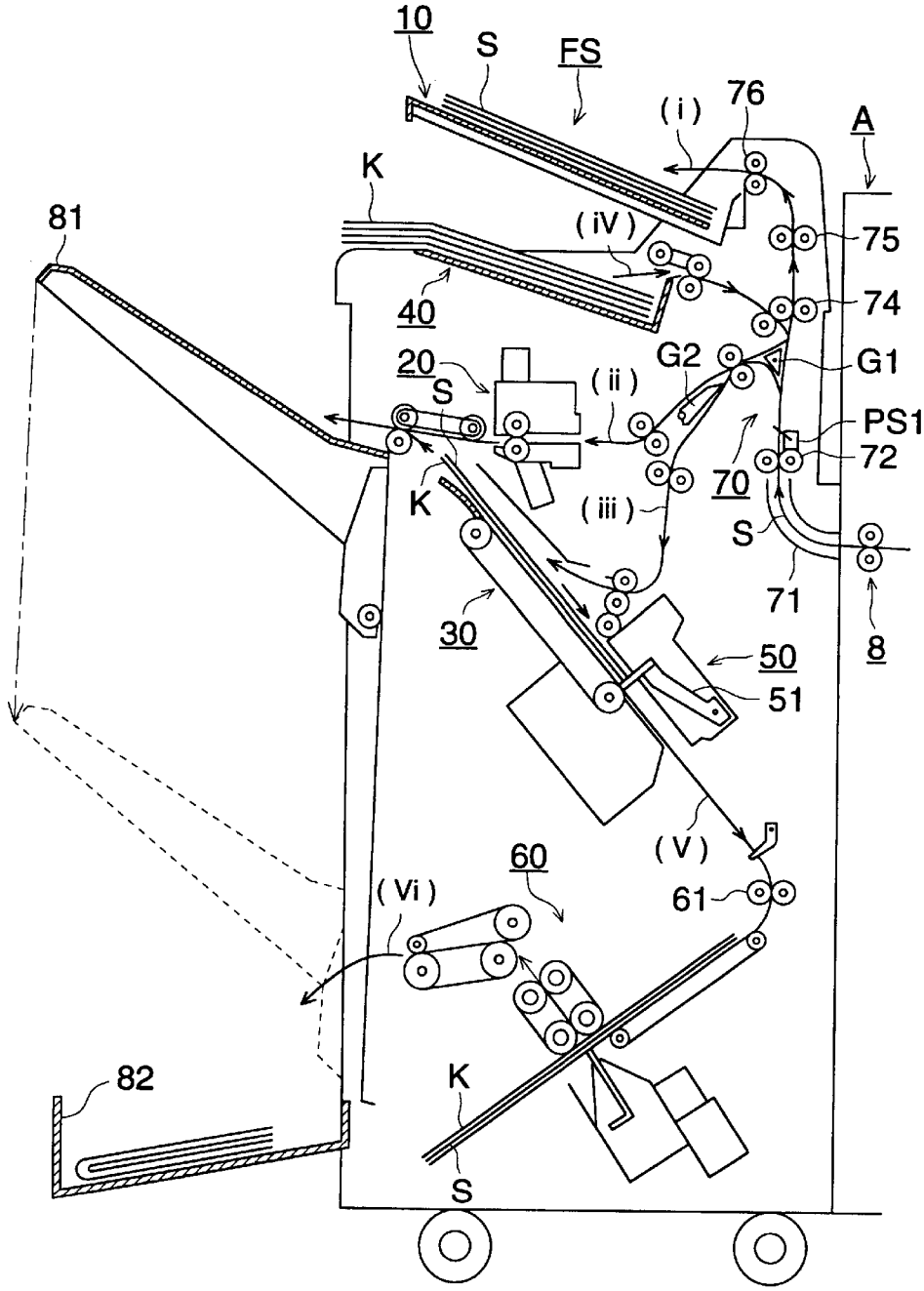
FIG. 2 is an illustration diagram showing a sheet conveyance path of the sheet finisher.
Figure 3:
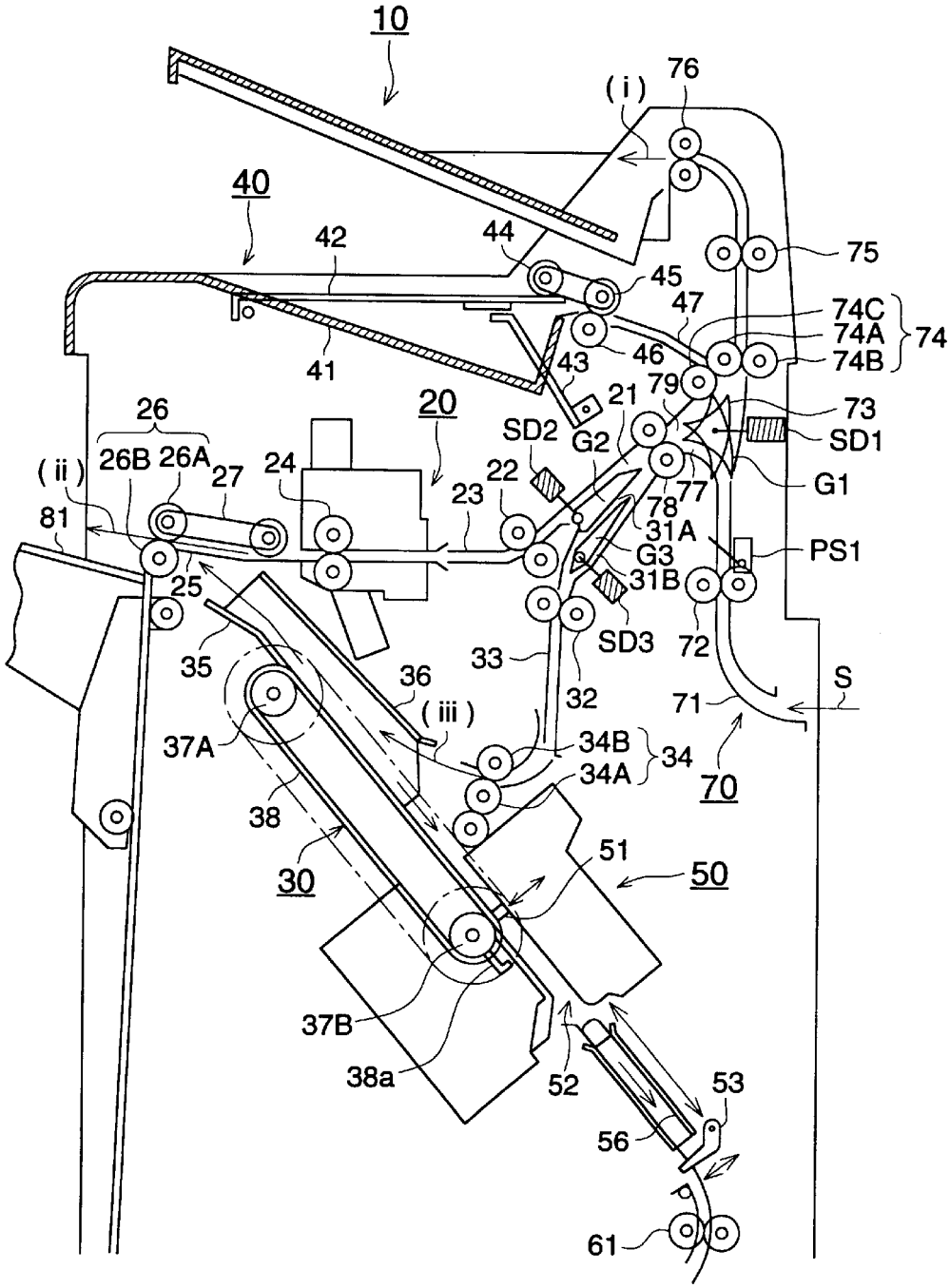
FIG. 3 is a sectional view showing the upper mechanism of the sheet finisher.

FIG. 2 is an illustration diagram showing the sheet conveyance path of sheet finisher FS, and FIG. 3 is a sectional view showing the upper mechanism of the sheet finisher FS.

The sheet finisher FS is installed by adjusting its position and height so that receiving portion 71 for recording sheet S conveyed out of image forming apparatus A may agree with sheet ejection section 8 of the image forming apparatus A.

A conveyance path for recording sheet S where entrance paired rollers 72 at the receiving portion 71 is connected to the downstream part of sheet conveyance is divided into three routes including first conveyance path (i) on the upper step, second conveyance path (ii) on the middle step and third conveyance path (iii) on the lower step, and they are arranged so that recording sheet S is directed to either one of them by selected an angle formed by switching gates G1 and G2.

The first conveyance path (i) ejects recording sheets onto fixed sheet ejection tray 10 on the upper part of the apparatus in non-staple mode and non-sort mode.

Recording sheet S having thereon a formed image ejected out of image forming apparatus A is guided to the receiving portion 71, then is conveyed by entrance paired rollers 72, then passes through path 73 on the right side of first switching gate G1 on the upper part, then is nipped by upper conveyance paired rollers 74 (driving roller 74A, driven roller 74B) and by conveyance paired roller 75 to be conveyed upward, and is further nipped by ejection paired rollers 76 to be ejected and stacked successively on fixed sheet ejection tray 10 located at the upper portion outside the apparatus.

In this process of sheet conveyance, switching gate G1 is swiveled by solenoid SD1 through its driving to close path 77 and to open path 73, making it possible for recording sheet S to pass to fixed sheet ejection tray 10.

As a capacity, the fixed sheet ejection tray 10 can hold the maximum of about 200 recording sheets S, and it can easily be taken out of the upper portion of sheet finisher FS.

The second conveyance path (ii) ejects recording sheets onto movable sheet ejection tray 81 in shift processing mode or non-sort mode.

Under this conveyance mode, switching gate G1 closes path 73 and opens path 77 when solenoid SD1 is turned off, making it possible for recording sheet S to pass through path 77.

Recording sheet S having thereon a formed image ejected out of image forming apparatus A passes through receiving portion 71 and entrance paired rollers 72, then passes through path 77 formed to be open under switching gate G1, then is nipped by conveyance paired rollers 78, then passes through path 21 above second switching gate G2 located downward obliquely which represents second conveyance path (ii), then is nipped by conveyance paired rollers 22, then passes through path 23, then is nipped by conveyance paired rollers (paired shift rollers) 24, then passes through path 25 to be ejected by ejection paired rollers 26 (upper roller 26A, lower roller 26B) and stacked on movable sheet ejection tray 81 which is located outside the apparatus. The numeral 27 represents a swiveling means which swivels upper roller 26A so that it may be brought into pressure contact with or separated from lower roller 26B.

As capacity, this movable sheet ejection tray 81 can hold the maximum of about 3000 (A4, B5) recording sheets S.

The third conveyance path (iii) ejects recording sheets onto movable sheet ejection tray 81 in an end stapling mode.

Recording sheet S having thereon a formed image processed in image forming apparatus A and fed into receiving portion 71 of sheet finisher FS passes through entrance paired rollers 72 and path 77 located under the first switching gate G1 and is nipped by entrance paired rollers 78 to be conveyed to third conveyance path (iii).

In the third conveyance path (iii), when large-sized recording sheet S larger than A4 and B5 is conveyed, solenoid SD2 is driven and recording sheet S passes through path 31A under switching gate G2 and is nipped by conveyance paired rollers 32 located at downstream portion to be further conveyed. The recording sheet S is nipped by conveyance paired rollers 34 located further at downstream portion (driving roller 34A, driven roller 34B) to be fed out, then is discharged into space above intermediate stacker 35 arranged to be inclined, and comes in contact with the upper surface of the intermediate stacker 35 or the upper surface of recording sheets S stacked on the intermediate stacker 35, then slides thereon to go up, and after the trailing edge in the advancing direction of the recording sheet S is ejected out of the conveyance paired rollers 34, the recording sheet S starts falling by its own weight, then slides down along the inclined surface of the intermediate stacker 35, and stops with its leading edge portion in the advancing direction hitting movable stopper member for end stapling (hereinafter referred to as an end stapling stopper) 51 which is in the vicinity of stapling means (stapling means) 50.

In the third conveyance path (iii), for improving copy productivity by conveying efficiently and continuously small-sized recording sheets S in A4 and B5 sizes, there are provided path 31B which is in parallel with path 31A lying under the switching gate GI and switching gate G3.

When solenoid SD2 for switching gate G2 and solenoid SD3 for switching gate G3 are driven simultaneously, tip portions of the switching gates G2 and G3 swivel counterclockwise in the illustration to close the paths 21 and 31A and to open the path 31B.

The tip portion of the first recording sheet S fed out of conveyance paired rollers 78 passes through the path 31B and stops after hitting the circumferential surface of the conveyance paired rollers 34 whose rotation is interrupted.

Next, electricity to solenoid SD3 is turned off, and the tip portion of switching gate G3 swivels clockwise to close path 31B and to open path 31A. The tip portion of the second recording sheet S fed out of conveyance paired rollers 78 passes through path 31A and stops after hitting the circumferential surface of the conveyance paired rollers 34 whose rotation is interrupted.

Taking the prescribed timing, the conveyance paired rollers 34 are driven to rotate and nip the two recording sheets S to convey them simultaneously, and discharge them on the intermediate stacker 35. The third sheet and thereafter are ejected out one by one.

The numeral 36 represents a pair of width-adjusting members provided on both sides of the intermediate stacker 35 on a movable manner. The width-adjusting members 36 can move in the direction perpendicular to the sheet conveyance direction, and it is opened to be broader than the sheet width when recording sheet S is discharged on the intermediate stacker 35 and the sheet is received, and when the recording sheet stops after hitting end stapling stopper 51, it conducts width-adjusting (width adjustment) for a bundle of sheets by tapping the side in the lateral direction of the recording sheets S. When prescribed number of recording sheets S are stacked and adjusted on the intermediate stacker 35 at this stop position, the process of stapling is carried out by stapling means 50, and a bundle of sheets is stapled.

On a part of a sheet stacking surface of the intermediate stacker 35, there is formed a cutout portion, and plural ejection belts 38 trained about driving pulley 37A and driven pulley 37B are driven to be capable of rotating. On a part of the ejection belt 38, there is solidly formed ejection claw 38*a*, and the tip portion of the ejection claw draws a locus of an elongated circle shown with a one-dot chain line in the illustration. A bundle of sheets which has been stapled is put on the ejection belt 38 with a rear end of the bundle of recording sheets S being supported by the ejection claw 38*a* of the ejection belt 38, and is pushed upward obliquely to slide on the stacking surface of the intermediate stacker 35 and to advance to the nipping position for ejection paired rollers 26. The bundle of sheets nipped by the rotating ejection paired rollers 26 is ejected and stacked on movable sheet ejection tray 81.

The fourth conveyance path (iv) feeds a cover sheet on feeding tray 41 in a cover sheet feeding mode.

Cover sheet feeding means 40 is structured with a cover sheet loading section composed of sheet feeding tray 41, movable bottom plate 42 and pushing up lever 43 and with a cover sheet feeding means composed of pickup roller 44, feed roller 45 and fanning roller 46.

A sheet of cover sheet K fed from cover sheet feeding means 40 passes through path 47, then passes through the position of nipping between driving roller 74A and driven roller 74C both of the conveyance paired rollers 74, then passes through path 79 and conveyance paired rollers 78, and arrives at intermediate stacker 35 through conveyance paired rollers 32 of the third path (iii), path 33 and conveyance paired rollers 34.

Conveyance paired rollers 74 is composed of central driving roller 74A, and two driven rollers 74B and 74C which are in pressure contact with the driving roller 74A. When the driving roller 74A rotates counterclockwise in the illustration, the driven roller 74B is rotated clockwise to convey recording sheet S conveyed through path 73 upward. Simultaneously with this, the driven roller 74C is also rotated clockwise to convey cover sheet K conveyed from path 47 to lower path 79. Therefore, the rotation of the driving roller 74A makes it possible to convey recording sheet S on the first conveyance path (i) and cover sheet K on the fourth conveyance path (iv) to the opposite directions each other simultaneously.

The fifth conveyance path (v) conveys recording sheets onto folding means 60 in midway stapling processing mode after the midway processing is carried out.

Figure 4:
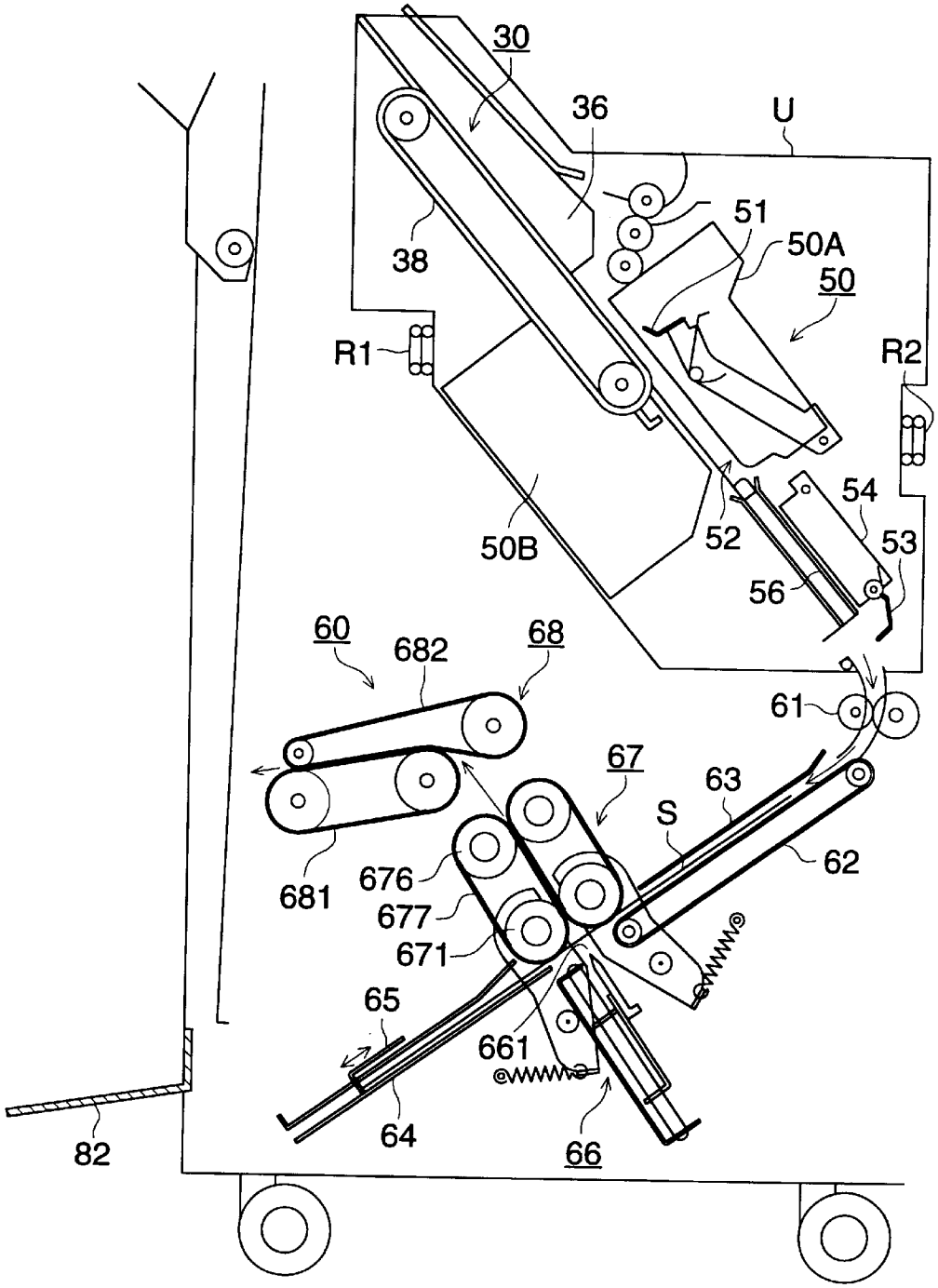
FIG. 4 is a sectional view showing the structure of the lower portion of the sheet finisher.

FIG. 4 is a sectional view showing a stapling section and a folding section of sheet finisher FS.

Stapling means 50, end stapling stopper 51 and movable stopper means for midway stapling (hereinafter referred to as a midway stapling stopper) 53 are formed in stapling unit U which is guided by guide rails R1 and R2 to be capable of being drawn out to the front side of sheet finisher FS.

The stapling means 50 is constituted with upper mechanism 50A and lower mechanism 50B to be of a two-piece structure, and between them, there is formed path 52 through which sheet S can pass.

Two sets of stapling means 50 are arranged in the direction perpendicular to the sheet conveyance direction, and they can be moved by an unillustrated driving means in the direction perpendicular to the sheet conveyance direction. By these stapling means 50, staples SP are stapled at two locations which are symmetrical about the center in the lateral direction of the sheet (see FIG. 6(*a*)).

When the midway stapling mode is set, end stapling stopper 51 which is close to the stapling position of the stapling means 50 retreats from the conveyance path, and midway stapling stopper 53 which is located at the downstream side thereof starts moving almost simultaneously with the aforesaid retreating to intercept the path 52.

When the size (length in the conveyance direction) of cover sheet K and recording sheet S is set or detected, the midway stapling stopper 53 moves to stop at the prescribed position.

After cover sheet K is placed at the prescribed position on intermediate stacker 35, recording sheet S conveyed out of image forming apparatus A passes through third conveyance path (iii) from entrance conveyance section 70 of sheet finisher FS, and is stacked successively on the upper surface of the cover sheet K placed on the intermediate stacker 35, and an end portion of the recording sheet S comes in contact with the midway stapling stopper 53 to be positioned. The numeral 56 represents a downstream side width adjusting means which regulates the lateral direction of the recording sheet S in the course of midway stapling processing, and it conducts width adjustment by tapping the side of recording sheet S in its lateral direction each time a sheet of recording sheet S is inserted, in the same way as of the upstream side width adjusting means 36.

The upstream side width adjusting means 36 and downstream side width adjusting means 56 conduct width adjusting drive selectively when end stapling processing or midway stapling processing is set. Namely, in the case of end stapling processing, the upstream side width adjusting means 36 only is driven, and the downstream side width adjusting means 56 is not driven. Due to this, less noise and power saving can be achieved.

For midway stapling processing, both upstream side width adjusting means 36 and downstream side width adjusting means 56 are driven. In the case of the midway stapling processing, the downstream side width adjusting means 56 is driven to be delayed from the upstream side width adjusting means 36. Due to this, overlapping of peak power in the start of the driving system can be avoided.

In the case of midway stapling processing, for recording sheet S which is conveyed on intermediate stacker 35 and advances at the upstream side of stapling means 50, upstream side width adjusting means 36 conducts width adjustment first for sheet arrangement, and then, downstream side width adjusting means 56 conducts width adjustment for sheet arrangement for recording sheet S which passes through stapling means 50 and advances toward midway stapling stopper 53. Thus, recording sheets S and cover sheet K which advance on intermediate stacker 35 and are stacked both at the upstream side and downstream side with stapling means 50 at the center are subjected to width adjustment accurately for the entire length of recording sheet S.

After the last recording sheet S is positioned and stacked on the intermediate stacker 35, a bundle of sheets composed of the cover sheet K and all pages of the recording sheets is subjected to midway stapling processing conducted by stapling means 50. Due to this midway stapling processing, staple SP is driven at the central portion in the conveyance direction for cover sheet K and recording sheets S. The staple SP is driven in the direction from lower mechanism 50B having the staple driving side to upper mechanism 50A having the staple clinching side.

The sixth conveyance path (vi) ejects recording sheets onto fixed ejection tray 82 in folding processing mode after the folding processing is carried out.

(6) Sixth conveyance path (vi) (folding processing mode)

After the midway stapling, the midway stapling stopper 53 swivels and opens the path on the downstream side on path 52. A bundle of sheets composed of cover sheet K and recording sheets S subjected to midway stapling passes through curved path and intermediate conveyance rollers pair 61 and is guided by guide plate 63 to be conveyed on conveyance belt 62 located to be obliquely lower, and further, conveyed on second sheet stacking section (stack stand) 64, and stops at the prescribed position with a leading edge portion of the bundle of sheets coming into contact with folding stopper 650 of folding movable stopper means 65. The folding stopper 650 can move to the prescribed position with setting or detection of the sheet size and with a driving means.

There is provided protruding unit 66 at the location obliquely lower than the central portion of a suspended bundle of sheets in its conveyance direction, namely at the location obliquely lower than the midway stapling position. At the location obliquely higher than the midway stapling position, there are provided folding paired rollers section 67 and twofold sheet conveyance means 68.

Folding means 60 is composed of protruding means 66, folding paired rollers section 67 and double-folded sheet conveyance means 68.

The signal for starting double-folding makes protruding plate 661 of protruding means 66 to go up straight obliquely, and the tip portion of the protruding plate 661 pushes up the central portion of a sheet bundle composed of cover sheet K and recording sheets S, and then spreads out a nipping portion of folding paired rollers 67 by force through the sheet bundle so that the folding paired rollers may be swung and separated.

After the tip portion of the protruding plate 661 has passed through the nipping section, the protruding plate 661 is retreated and the central portion of the bundle of sheets is nipped and pressed by the folding paired rollers section 67 to be rimpled. The rimple thus formed mostly agrees in terms of position with the stapling position in the midway stapling processing for a staple on the bundle of sheets.

The central portion of the sheet bundle on which a crease is formed by pressing of first pressing roller (folding roller) 671 of the rotating paired rollers of folding paired rollers 67 is nipped and conveyed by paired conveyance belts 677 to be fed into the nipping position of paired second pressing rollers 676 where the crease is further formed clearly, and is fed into double-folded sheet conveyance means 68.

The bundle of sheets fed into by the twofold sheet conveyance means 68 is nipped between the lower conveyance belt 681 and the upper conveyance belt 682 to be conveyed, and is ejected onto fixed sheet ejection tray 82 which is located outside the apparatus.

Figure 5:
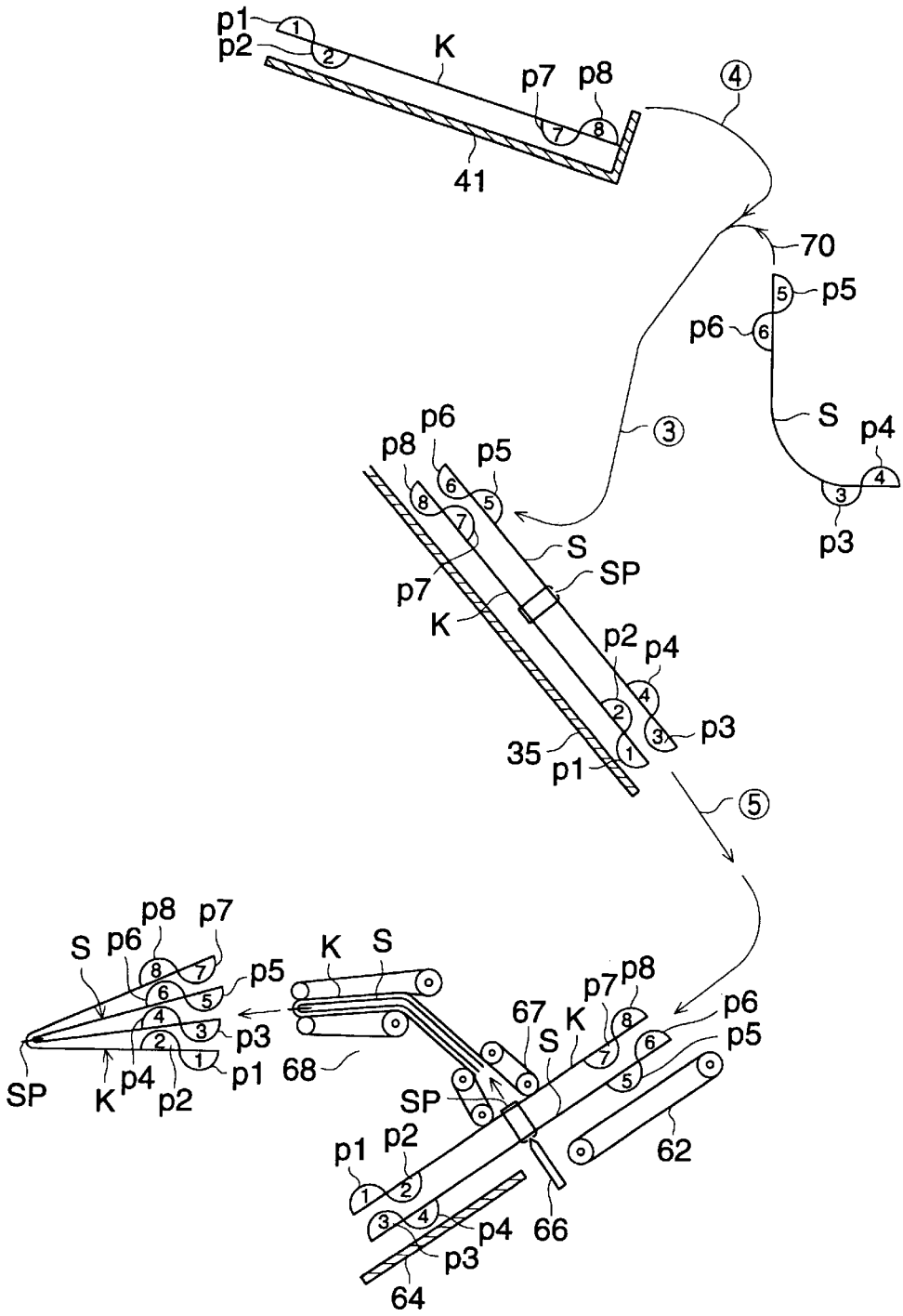
FIG. 5 is an illustration showing processes for midway stapling and double folding processing.
Figure 6:
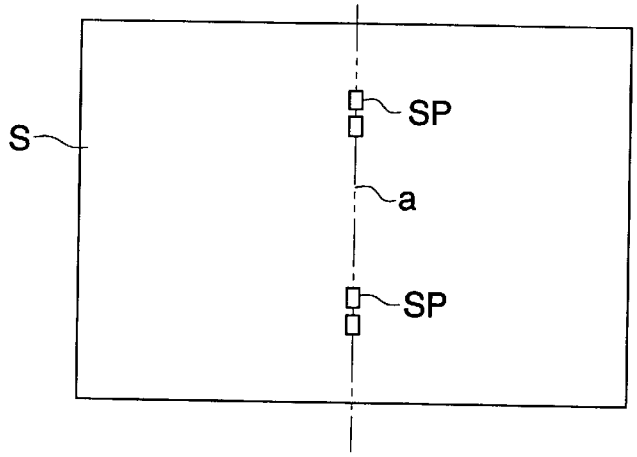
FIG. 6(*a*) is a plan view of a sheet showing midway stapling processing, FIG. 6(*b*) is a perspective view of a booklet which has been subjected to finishing processing of midway stapling and double folding, and FIG. 6(*c*) is a perspective view showing the finished booklet which is opened.
Figure 6:
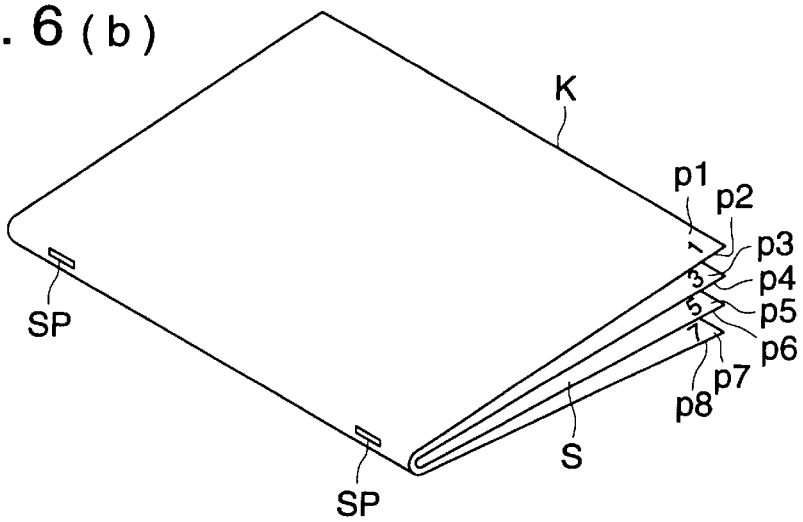
Figure 6:
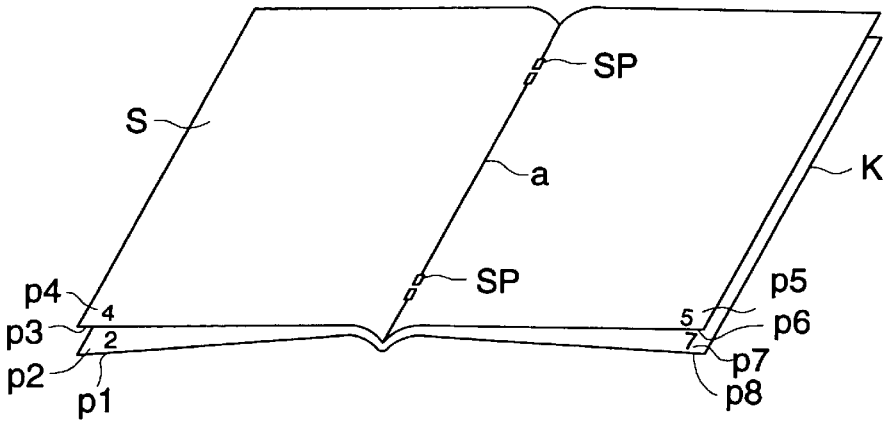

FIG. 5 is an illustration diagram showing the conveyance path for the cover sheet K and recording sheets S, and the processing process for midway stapling and folding of a bundle of sheets. FIG. 6(*a*) is a plan view of a sheet showing midway stapling processing wherein staples SP are driven at two locations symmetrical about the center along a crease of folded recording sheet S. FIG. 6(*b*) is a perspective view of a booklet which has been subjected to finishing of midway stapling and folding, and FIG. 6(*c*) is a perspective view showing the finished booklet which is opened.

On sheet-feeding tray 41 of cover sheet-feeding means 40, there is placed cover sheet K with its first surface (p1 on page 1 and p8 on page 8) facing upward. Cover sheet K fed from sheet-feeding tray 41 by the sheet-feeding means is conveyed through the fourth conveyance path (iv) and the third conveyance path (iii) and is placed, with its first surface (p1, p8) facing downward, on intermediate stacker 35.

Next, recording sheet S having thereon a formed image conveyed out of image forming apparatus A is guided, with its first surface (p1 on page 3 and p6 on page 6) facing downward into sheet finisher FS. This recording sheet S is conveyed from entrance conveyance section 70 to the third conveyance path (iii) and then is placed with its first surface facing downward on cover sheet K that is placed on intermediate stacker 35.

The cover sheet K and the recording sheets are collated and adjusted on the intermediate stacker 35, and staple SP is driven in them by stapling means 50, for the midway stapling processing.

A bundle of sheets subjected to midway stapling passes through fifth conveyance path (v), then is placed at the prescribed position on second sheet stacking stand (stack stand) 64 and conveyance belt 62, and is stopped. In this case, the bundle of sheets is placed in a way wherein the first surface (p3 on page 3 and p6 on page 6) of the recording sheet S faces upward and the first surface (p1, p8) of the cover sheet K superposed on the recording sheet faces upward.

Then, twofold processing is carried out by pushing up operation of protruding means 66 and by rotation of folding paired rollers section 67, and then, twofold sheet conveyance means 68 nips and conveys to eject onto fixed sheet ejection tray 82 located outside the apparatus.

With regard to the booklet made through midway stapling processing and folding processing, the first surface (p1, p8) of cover sheet K is turned toward the outside, the second surface (p2, p7) is arranged on the back side of the first surface, the first surface (p3, p6) of recording sheet S representing contents is arranged inside the second surface, and the second surface (p4, p5) of recording sheet S is arranged inside the first surface of the recording sheet S, thus, collation of the booklet having therein 8 pages (p1–p8) as illustrated can be conducted.

In operation section of image forming apparatus A, when printing is started by selecting and setting a booklet making automatic mode and by stacking cover sheets K on sheet-feeding tray 41, the image processing is executed by the control section of image forming apparatus A, then, recording sheet S carrying images is subjected to midway stapling and folding processing by sheet finisher device FS, and booklets are continuously made and ejected.

In operation section of sheet finisher device FS, when feeding out operation is started by selecting and setting a booklet making manual mode and by stacking cover sheet K and stacking recording sheets S each having thereon a formed image equivalent in terms of quantity to one copy under the cover sheet K on sheet-feeding tray 41, the cover sheet K and recording sheets S are subjected to midway stapling processing and folding processing by control section of sheet finisher FS, and a booklet equivalent to one copy is made and ejected out.

Figure 7:
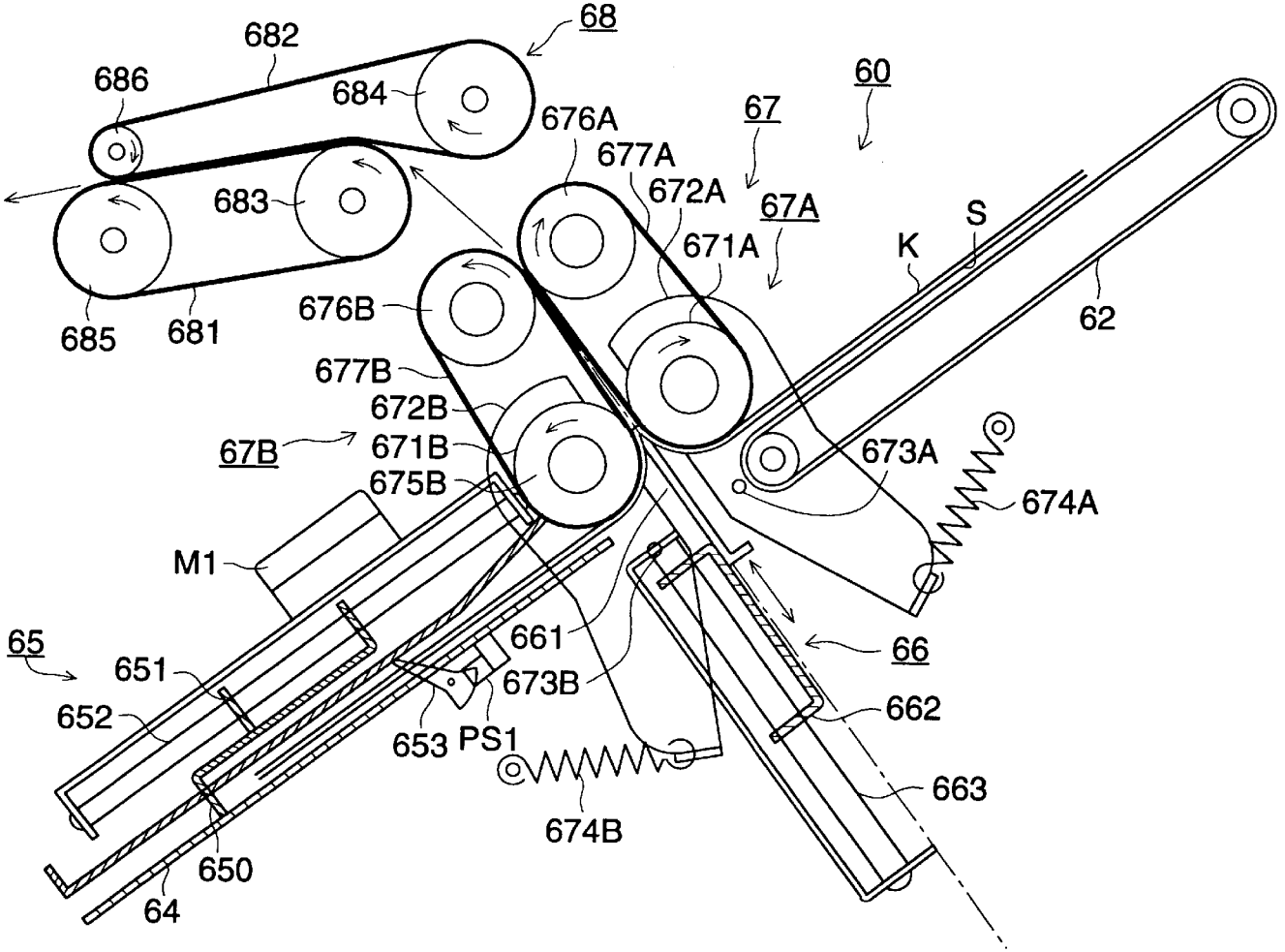
FIG. 7 is a sectional view of a folding means which is composed of a movable stopper for a folded portion, a protruding means, a portion of paired folding rollers and a double-folded sheet conveyance means.
Figure 8:
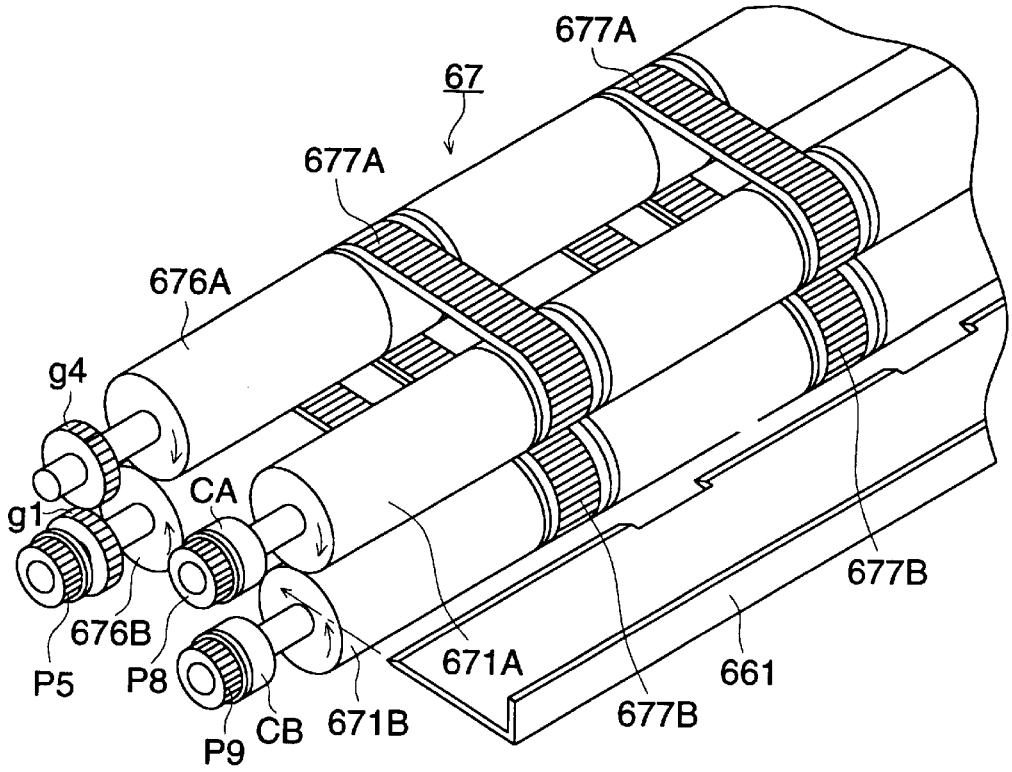
FIG. 8 is a perspective view showing a portion of paired folding rollers and a protruding plate of a protruding means.

FIG. 7 is a sectional view of folding means 60 which is composed of folding section movable stopper 65, protruding means 66, folding paired rollers section 67 and double-folded sheet conveying means 68. FIG. 8 is a perspective view of folding paired rollers section 67 and of protruding plate 661 of protruding means 66.

The folding section movable stopper 65 comes in contact with the top portion of a bundle of sheets in various sizes to position the tip portion. Folding section stopper 650 is fixed on holding member 651. The holding member 651 is driven by motor M1 to move straight while sliding on guide bar 652. Actuator 653 and sensor PS1 detect passage of the tip portion of a sheet conveyed on second sheet stacking section 64.

The signal for starting double-folding makes movable holding member 662 to advance straight along guide bar 663 which is arranged to be fixed, and protruding plate 661 fixed on the movable holding member 662 is protruded above the sheet placing surface. The protruding plate 661 is a knife-shaped thin plate such as a stainless steel plate and its tip portion has a sharp angle. The tip portion of the protruding plate 661 is formed to be a low friction surface with surface treatment of, for example, a glossy finish or Teflon coating.

Pressing means 67A on one side of folding paired rollers section 67 is composed of a preceding folding section which is made up of first pressing roller (folding roller) 671A connected to the driving source to be driven, arm 672A which supports the folding roller 671A rotatably and is capable of swiveling on supporting shaft 673A, and spring 674A which is hooked on one end of the arm 672A and urges the folding roller 671A toward the nipping position, and of a following folding section which is made up of second pressing roller (folding roller) 676A connected to the driving source to be driven and conveyance belt 677A trained about the folding roller 671A and the pressing roller 676A.

Pressing means 67B on the other side also has the same constitution and it has therein first pressing roller (folding roller) 671B, arm 672B, supporting shaft 673B, spring 674B, second pressing roller (folding roller) 676B, and conveyance belt 677B. Incidentally, the pressing rollers 676A and 676B are rotatably supported by unillustrated arm, supporting shaft and spring which are the same as those for the folding rollers 671A and 671B.

At least one pressing roller among paired pressing rollers 676A and 676B has a surface layer of elastic material. For example, the pressing roller 676A is a rubber-coated roller, while, the pressing roller 676B is a hard roller such as a metallic one. Or, materials for the pressing rollers 676A and 676B may also be opposite to the foregoing.

The rubber-coated roller is made of an elastic material such as ethylene-propylene rubber (EPDM), acrylonitrile-butadiene rubber (NBR) and chloroprene rubber (CR).

When both of paired pressing rollers are metallic rollers, impact noises caused by collision of metallic rollers are generated when the rear end portion of a sheet bundle passes through the pressure contact position between the pressing rollers.

Incidentally, it is effective for maintaining uniform pressing force in the course of folding processing that either one of the paired pressing rollers 676A and 676B is a hard roller such as a metallic roller.

A central portion of a bundle of sheets nipped and pressed by rotating folding rollers 671A and 671B so that a crease is formed is held between conveyance belts 677A and 677B, and the bundle of sheets is conveyed to be fed into the nipping position between pressing rollers 676A and 676B where the crease is formed more clearly, and the bundle of sheets is fed into double-folding sheet conveyance means 68.

The double-folding sheet conveyance means 68 is composed of lower conveyance belt 681 and upper conveyance belt 682 both conveying the bundle of sheets by pressing it from both sides. The lower conveyance belt 681 is trained about conveyance rollers 683 and 685 supported rotatably at both ends, and the lower conveyance belt 681 is driven by conveyance roller 685 to rotate. The upper conveyance belt 682 is trained about conveyance rollers 684 and 686 supported rotatably at both ends, and it is driven by the lower conveyance rollers 683 and 685 to rotate. The conveyance roller 686 is arranged to be pushed up by a bundle of sheets when the sheet bundle enters, and to be capable of retreating upward.

The sheet bundle fed into the double-folded sheet conveyance means 68 is nipped between the lower conveyance belt 681 and the upper conveyance belt 682 to be conveyed, and is ejected on fixed sheet ejection tray 82 located outside an apparatus.

Figure 9:
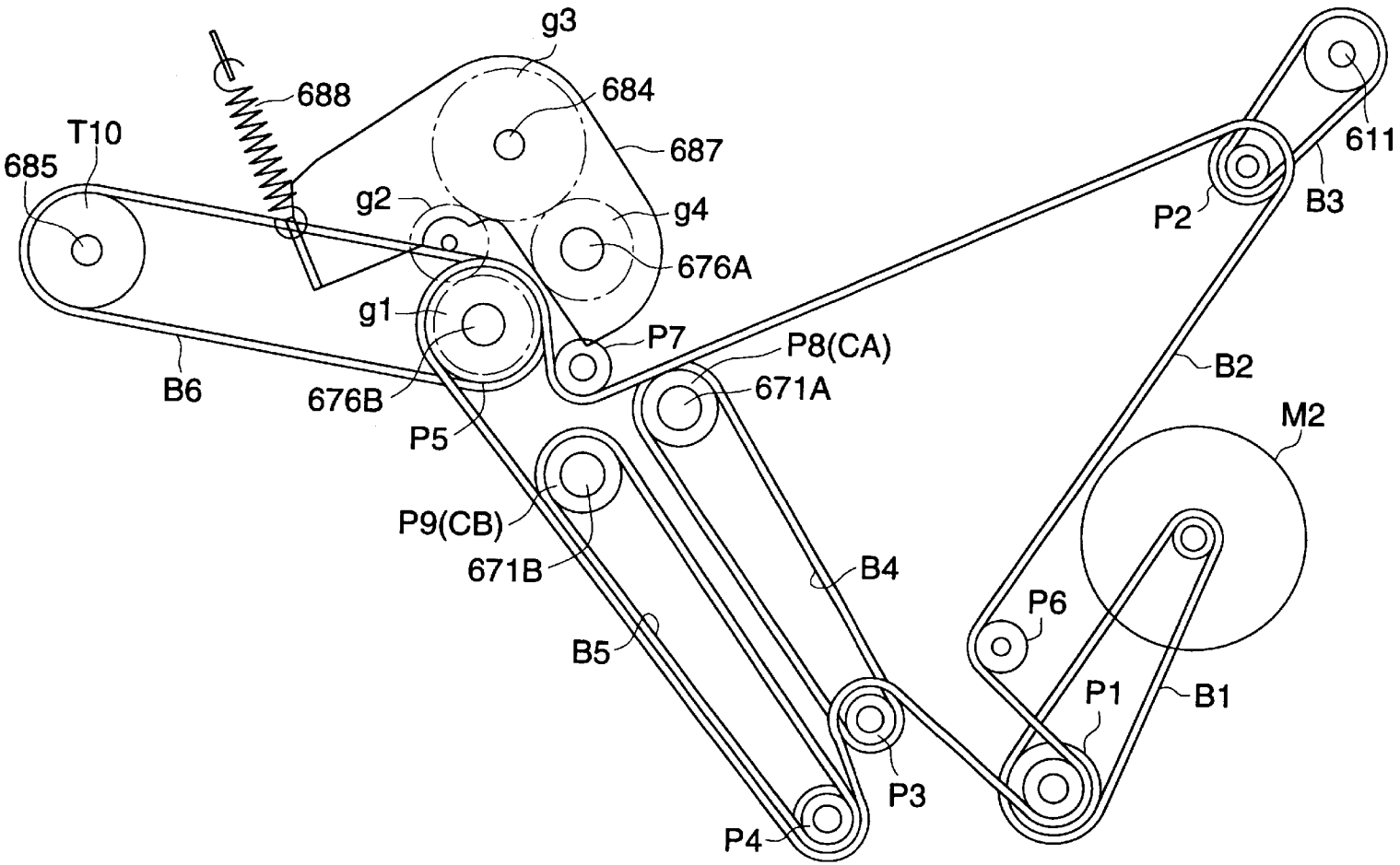
FIG. 9 is a structure diagram of a driving system which drives a folding means and paired intermediate conveyance rollers.

FIG. 9 is a structure diagram of a driving system which drives folding rollers 671A and 671B of folding means 60 shown in FIG. 7, pressing rollers 676A and 676B, lower conveyance belt 681 and upper conveyance belt 682, conveyance belt 62 and intermediate paired conveyance rollers 61 (see FIG. 3).

Motor M2 rotates two-step pulley P1 which is supported rotatably on the intermediate shaft through timing belt (hereinafter referred to as a belt). Belt B2 is trained about the two-step pulley P1 to rotate pulley P2. The pulley P2 rotates drive roller 611 of intermediate conveyance roller 611 through belt B3.

The belt B3 trained about pulley P2 is further trained about pulleys P3 and P4 on the intermediate shaft and about pulley P5 fixed on an end of the shaft for pressing roller 676B to rotate them simultaneously. P6 and P7 represent a tension roller.

Pulley P3 on the intermediate shaft rotates pulley P8 which is fixed on an end of the shaft for folding roller 671A through belt B4. Pulley P4 on the intermediate shaft rotates pulley P9 which is fixed on an end of the shaft for folding roller 671B through belt B5.

In pulley P8 provided on an end of the shaft for folding roller 671A, there is housed one-way clutch CA. Further, in pulley P9 provided on an end of the shaft for folding roller 671B, there is housed one-way clutch CB.

Pulley P5 rotates pulley P10 which is fixed on an end of the shaft for roller 685 through belt B6.

Gear g1 fixed on an end of the shaft for pressing roller 676B is connected to gear g4 through intermediate gears g2 and g3 supported rotatably at the fixed position on the panel of the apparatus main body.

The intermediate gear g3 is fixed on an end of the shaft for conveyance roller 684 supported on the panel of the apparatus main body. The intermediate gear g4 is fixed on an end of the shaft for pressing roller 676A supported on swiveling plate 687.

Two swiveling plates 687 are supported respectively on both shaft ends of conveyance roller 684 on which intermediate gear g3 is fixed so that the swiveling plates may swivel, and they are urged by spring 688. Both shaft ends of pressing roller 676A on which intermediate gear g4 is fixed are supported rotatably by the swiveling plates 687.

Pressing roller 676A supported on swiveling plate 687 swivels on the axis of rotation of conveyance roller 684, and is urged by spring 688 to be brought into pressure contact with pressing roller 676B.

Figure 10:
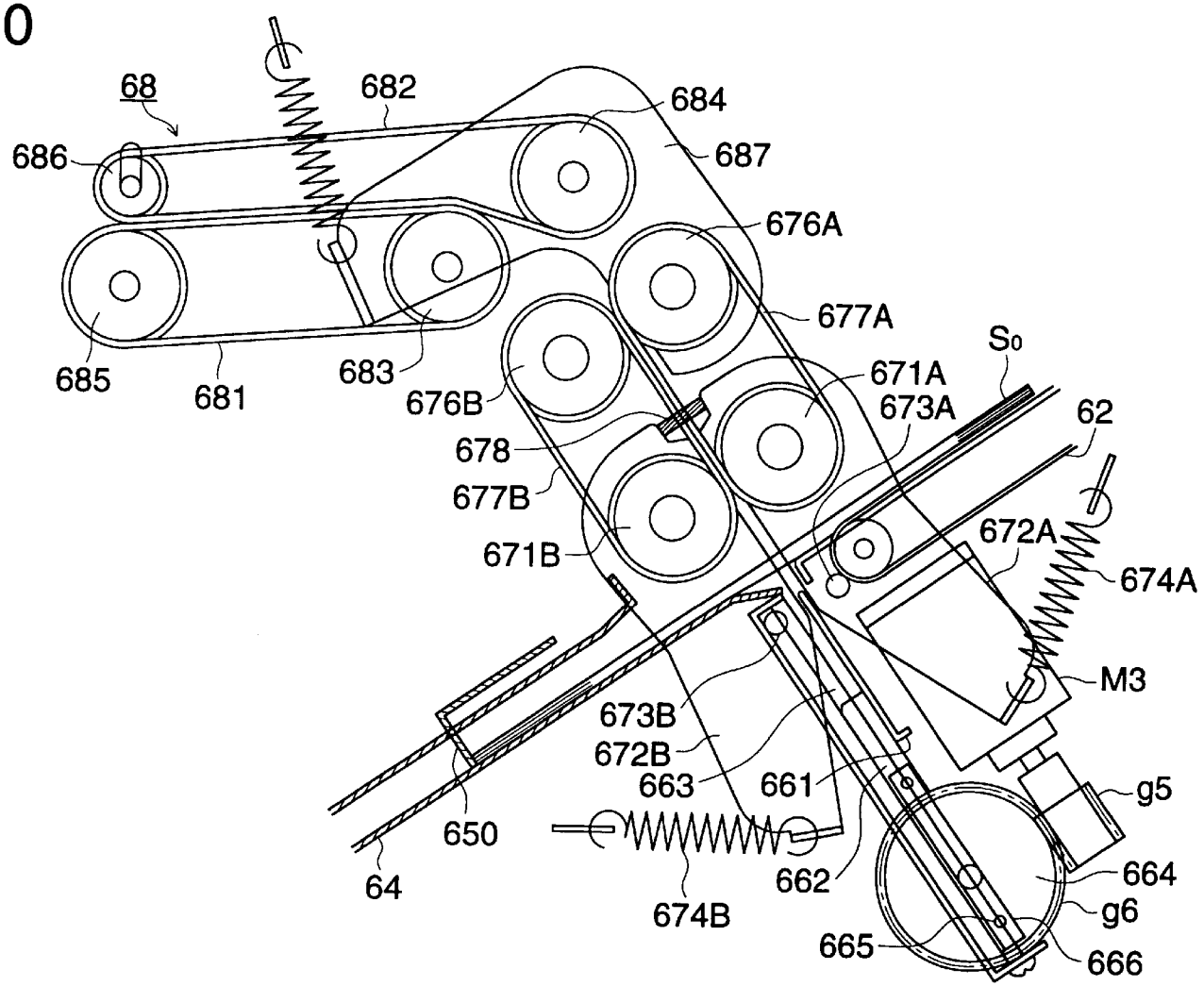
FIG. 10 is a sectional view showing the state of a bundle of sheets which is about to be folded in two.

FIG. 10 is a sectional view showing how sheet bundle $S_0$ looks immediately before the sheet bundle S is subjected to double-folding processing.

Motor M3 rotates disk 664 on which eccentric pin 665 is studded through gears g5 and g6, and thereby, crank 666 makes movable holding member 662 to reciprocate straight along two guide bars 663.

Arm 672A which supports folding roller 671A and arm 672B which supports folding roller 671B are arranged to be symmetrical so that protruding plate 661 may be inserted into the pressure contact position between the folding roller 671A and folding roller 671B, and they are urged uniformly by springs 674A and 674B to be held at their stopped state by stopping member 678. In this stopped state, a tip portion of each of arms 672A and 672B comes in contact with stopping member 678 so that an outer circumferential surface of each of folding rollers 671A and 671B may be close to each other or may come in contact slightly with each other.

Figure 11:
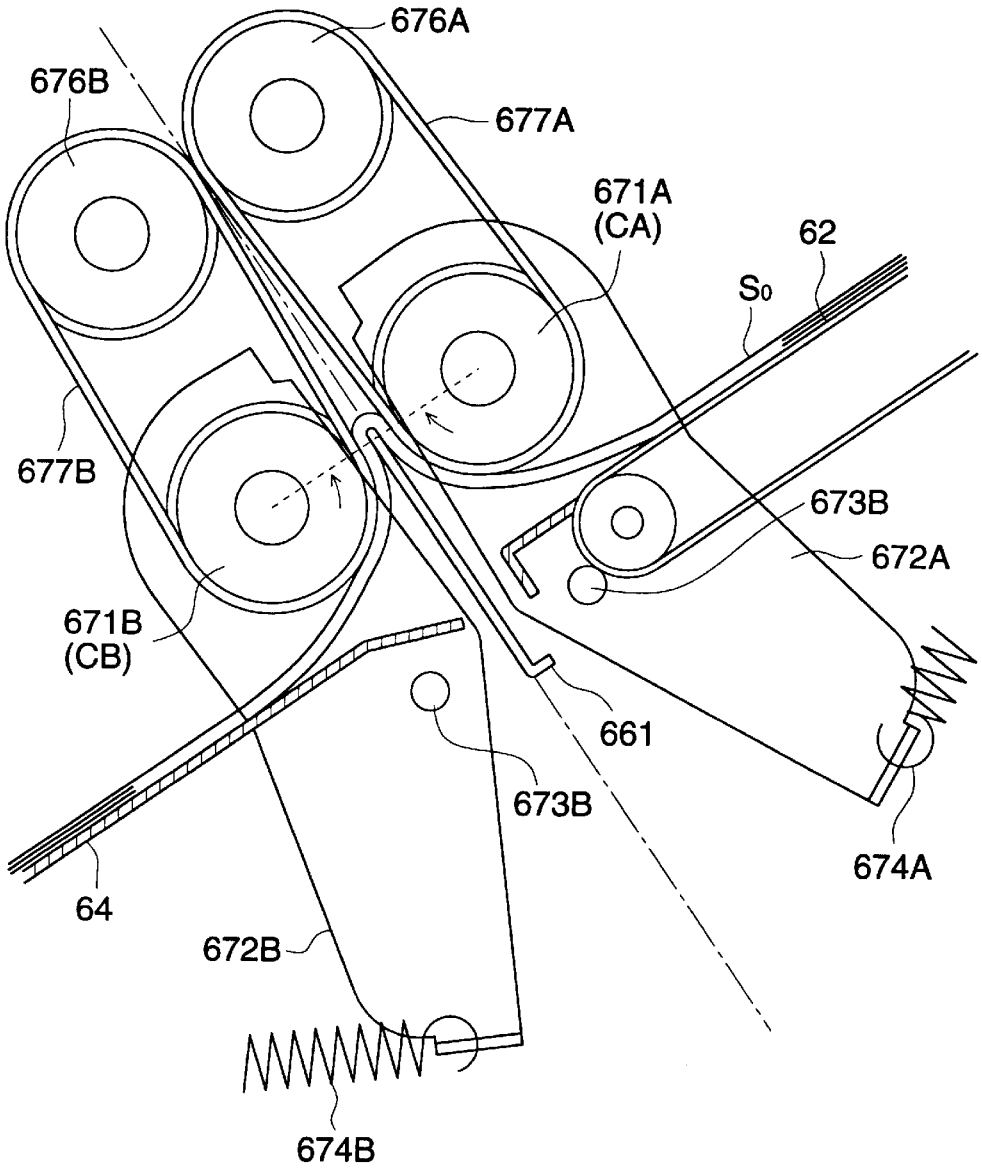
FIG. 11 is a sectional view showing how a sheet folding section passes in double folding.

FIG. 11 is a sectional view showing how the sheet folding section passes in double-folding processing.

Upon the start of driving of the motor M3, protruding plate 661 held on movable holding member 662 advances. The tip portion of the protruding plate 661 protrudes the central portion (crease section "a") of sheet bundle $S_0$ in the sheet conveyance direction to feed it to the pressure contact position of folding rollers 671A and 671B which are not rotating so that the sheet bundle $S_0$ may be folded in two.

When the folded portion of the sheet bundle $S_0$ is protruded by the tip portion of the protruding plate 661 to slide on the outer circumferential surfaces of folding rollers 671A and 671B and thereby to be fed to the pressure contact position, one-way clutches CA and CB provided respectively on ends of shafts for folding rollers 671A and 671B make the folding rollers 671A and 671B to be rotated by the moving sheet bundle $S_0$ to rotate only in the sheet conveyance direction.

When the tip portion of the protruding plate 661 advances to the utmost protruding position which exceeds the pressure contact position of the folding rollers 671A and 671B slightly (by 1–3 mm), the folding rollers 671A and 671B are driven to start rotating. The protruding plate 661 starts retreating simultaneously with or slightly behind the moment when the folding rollers 671A and 671B are driven to start rotating. Further, when occurrence of creases on a sheet and shifting of a sheet bundle need to be avoided, folding rollers 671A and 671B are controlled not to be driven to start rotating even when the tip portion of the protruding plate 661 arrives at its utmost protruding position, and to be driven to start rotating when the protruding plate 661 is retreated to pass through the pressure contact position afterward.

Due to retreating of the tip portion of the protruding plate 661, the tip portion of the protruding plate 661 is drawn out of the folded portion of sheet bundle $S_0$, and then, the folded portion of sheet bundle $S_0$ is brought into pressure contact with outer circumferential surfaces of the folding rollers 671A and 671B to be held therein, thus, the fold is clearly formed.

When the tip portion of the protruding plate 661 is drawn out of the folded portion of the sheet bundle $S_0$, the sheet bundle $S_0$ is not retreated because the folding rollers 671A and 671B are prevented from rotating reversely by one-way clutches CA and CB.

Figure 12:
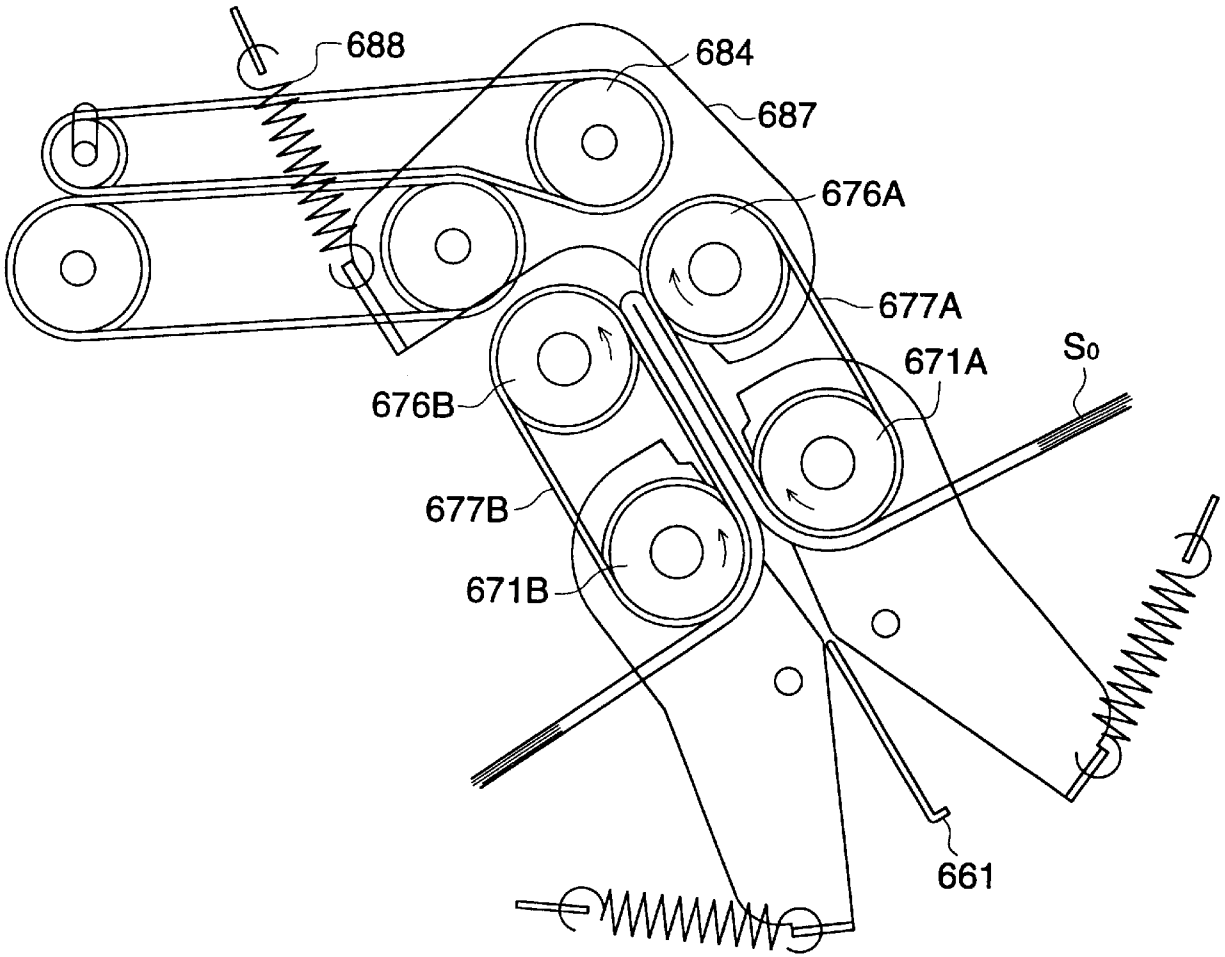
FIG. 12 is a sectional view showing how a sheet pressing section passes in double folding.

FIG. 12 is a sectional view showing how sheets pass through pressing section in double-folding processing.

The tip portion of the sheet bundle $S_0$ which has passed the pressure contact position of the rotating folding rollers 671A and 671B is interposed between rotating conveyance belts 677A and 677B to be fed into the pressure contact position of the rotating folding rollers 676A and 676B. The tip portion of the sheet bundle $S_0$ is pressed between pressing roller 676B that is rotating at the fixed position and pressing roller 676A which is supported rotatably on swiveling plate 687 to rotate, thus the fold is formed more clearly.

The sheet bundle which passes through the pressure contact position between the folding rollers 671A and 671B and the pressure contact position between the pressing rollers 676A and 676B is interposed between the rotating conveyance belts 677A and 677B to be conveyed smoothly, independently of a thickness of the sheet bundle.

Figure 13:
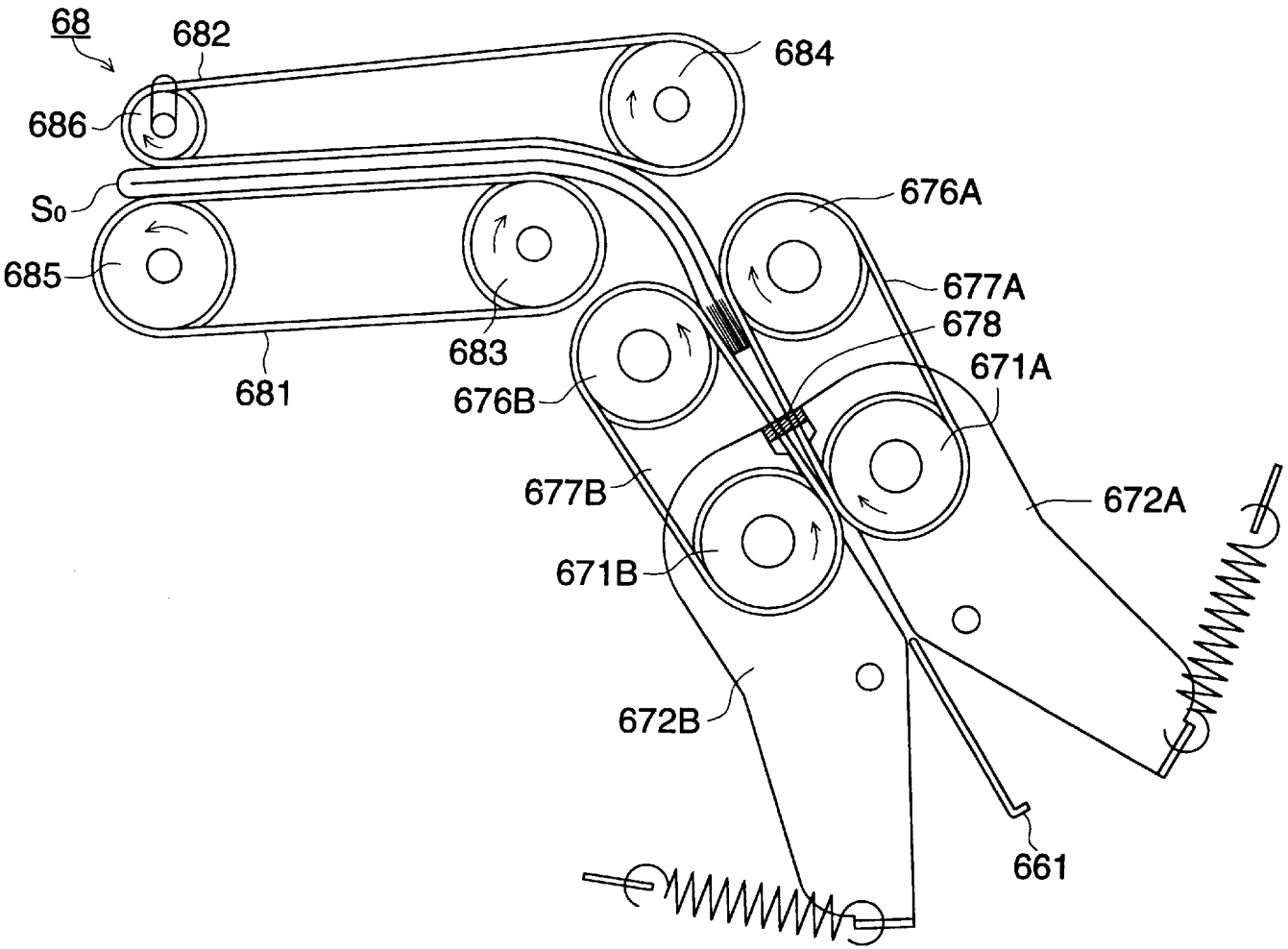
FIG. 13 is a sectional view showing how double-folded sheets are conveyed.

FIG. 13 is a sectional view showing how double-folded sheets are conveyed.

The tip portion of sheet bundle $S_0$ which has passed through the pressure contact position of the rotating pressing rollers 676A and 676B is interposed between rotating lower conveyance belt 681 and upper conveyance belt 682 to be conveyed, and is ejected out of an apparatus. When the rear end portion has passed the sheet bundle $S_0$ , folding rollers 671A and 671B are returned to their initial state where the folding rollers 671A and 671B are closed, and a tip portion of arm 672A and that of arm 672B come in contact with stopper member 678 to be stopped. Due to this, occurrence of noise caused by closing of folding rollers is reduced.

The lower conveyance belt 681 is trained about conveyance roller 685 connected to the driving source and about driven conveyance roller 683 to be rotated. The upper conveyance belt 682 is trained about conveyance roller 684 and about conveyance roller 686 which can move vertically along a longitudinal groove to be rotated.

(ANOTHER EMBODIMENT)

In the embodiment stated above, there has been shown an arrangement wherein protruding plate 661 of sheet protruding means 66 reciprocates straight along guide bar 663, to which, however, the invention is not limited.

Figure 14:
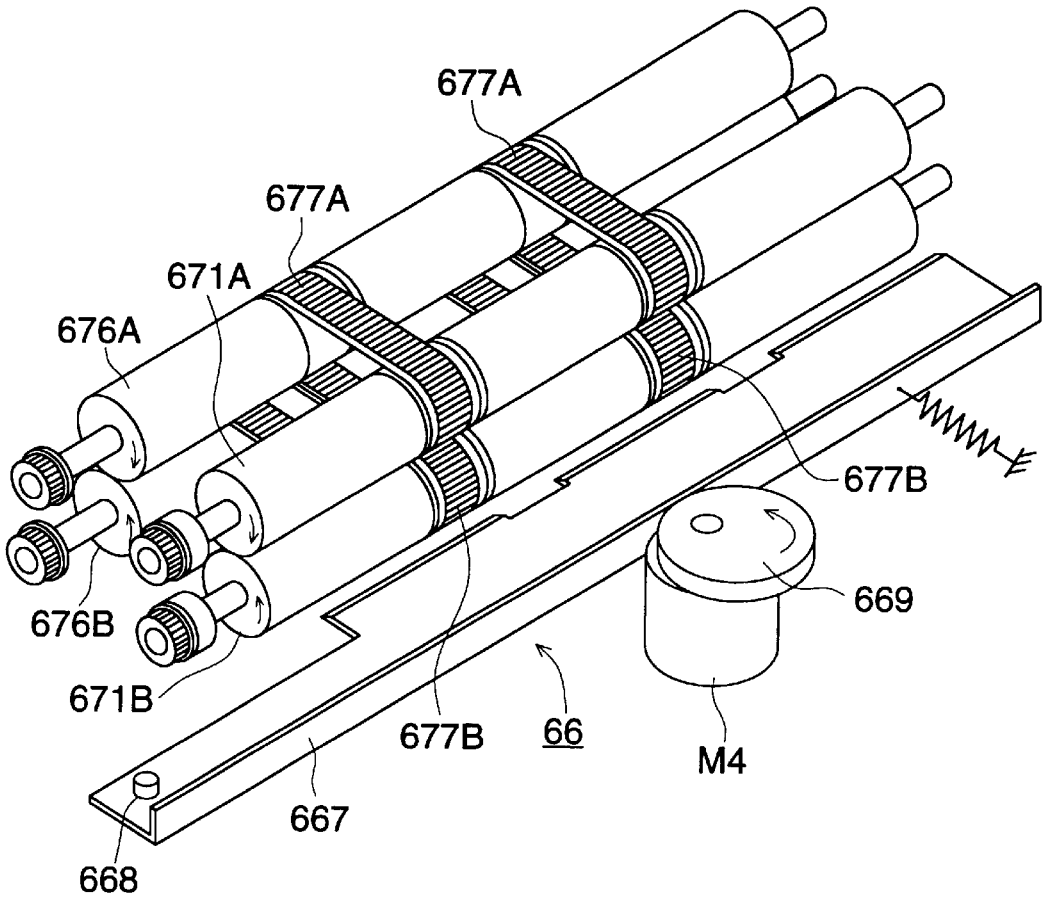
FIG. 14 is a perspective view showing another embodiment of the sheet protruding means.

FIG. 14 is a perspective view showing another embodiment of a sheet protruding means.

Protruding plate 667 is supported rotatably on supporting shaft 668 which serves as a fulcrum. The protruding plate 667 is urged by a spring so that the rear surface of the protruding plate 667 may be brought into contact with cam 669 which is rotated by motor M4. Rotation of cam 669 makes the protruding plate 667 to swivel around supporting shaft 668 to advance to the pressure contact position of folding rollers 671A and 671B for double-folding processing of a sheet bundle.

A shape of the tip portion of the protruding plate 667 is not limited to the direction perpendicular to the sheet conveyance direction.

In addition, with regard to a folding roller and a pressing roller, the number of each of them is not limited to one pair each, but any number of pairs may be arranged as occasion demands.

Figure 15:
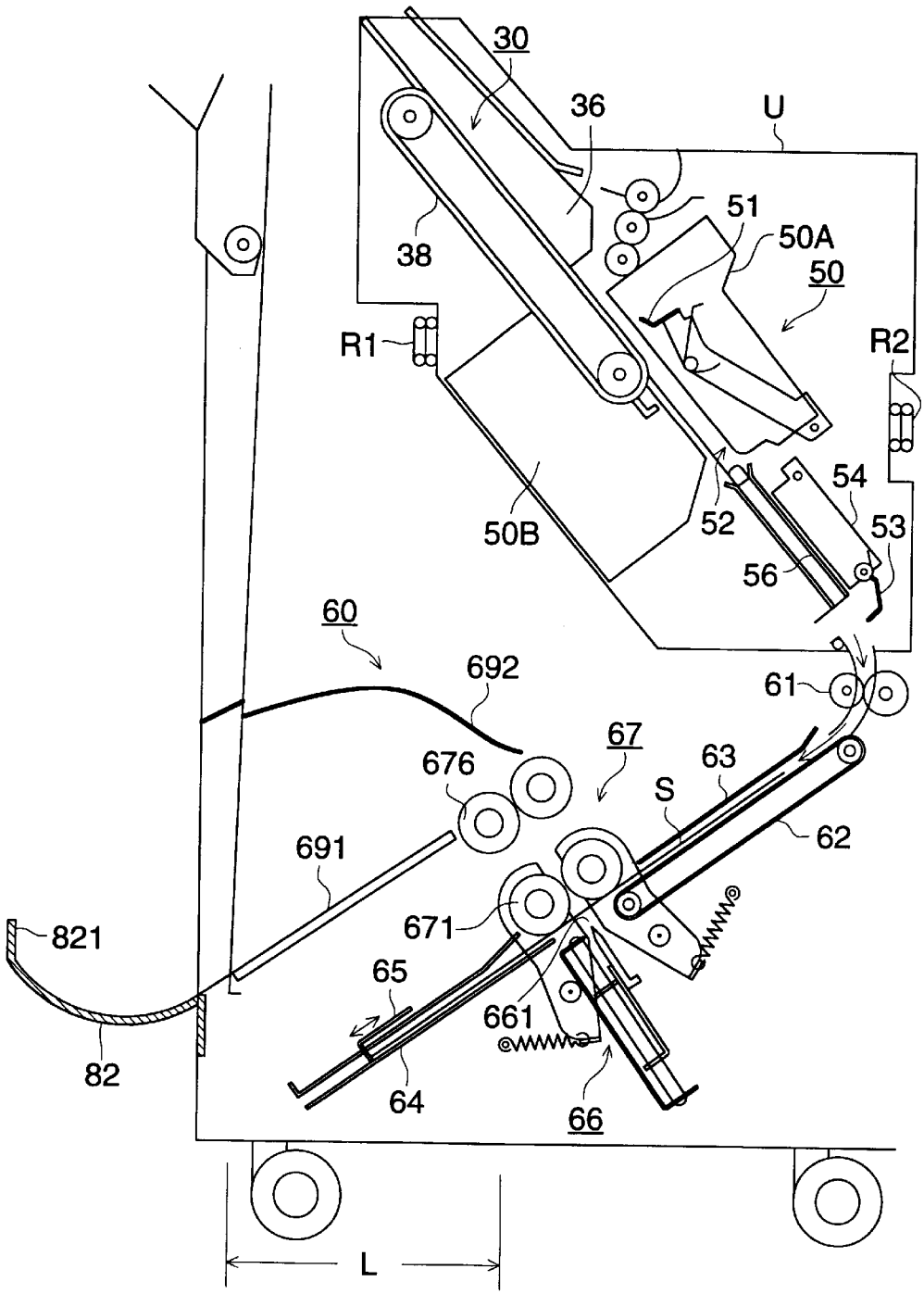
FIG. 15 is a sectional view of another embodiment showing how double-folded sheets are conveyed.

FIG. 15 is a sectional view of another embodiment showing how double-folded sheets are conveyed.

The booklet ejected by the pressing roller 676 is delivered along upper guide plate 692, brought into contact with lower guide plate 691, and then stacked on the fixed exit tray 82. The numeral 821 shows a rising portion for preventing the booklet from jumping out from the fixed exit tray 82. The lower guide plate 691 has a length L which is more than that of A5 size sheet (150 mm).

Incidentally, though there is shown a sheet finisher connected to a copying machine in the present embodiment of the invention, the invention can be applied also to a sheet finisher used through connection with an image forming apparatus such as a printer and a facsimile machine or with a simple printing machine.

As stated above, the invention provides the following excellent effects.

(1) It is possible to obtain a bundle of sheets folded neatly wherein sheet slip caused by relative movement between a sheet of the outermost layer of a sheet bundle and a sheet of an inner layer is prevented, and sheet damages such as creases and tears are not caused.

(2) In the state before the start of folding processing, paired folding rollers are stopped by a stopping member at the prescribed position, thereby excessive pressing force is not applied, and a protruding plate can be inserted accurately in the pressure contact position of paired folding rollers, thus the folding processing can be conducted at the correct position. Further, after the rear end portion of a sheet bundle has passed through the paired folding rollers, collision of the paired folding rollers can be avoided.

(3) When the tip portion of the protruding plate is drawn out of the folded portion of the sheet bundle, the sheet bundle is not retreated from the interposing section of the paired folding rollers because they are prevented by one-way clutches from rotating reversely, thus, the folding processing can be conducted surely.

(4) By making a pressing roller on at least one side among paired pressing rollers to be a rubber-coated roller having a surface layer made of an elastic material and by making a pressing roller on the other side to be a hard roller such as a metallic roller, it is possible to prevent generation of impact noises which are caused by collision of paired pressing rollers when the rear end portion of a sheet bundle passes through the pressure contact position.

(5) By connecting paired folding rollers and paired pressing rollers with a driving source, linearity of conveyance of a bundle of sheets can be secured, and folding efficiency for the thick bundle of sheets, in particular, can be improved.

(6) By conveying a sheet bundle by interposing it between a pair of flat belts through the sheet bundle conveyance path between paired folding rollers and paired pressing rollers, introduction of the sheet bundle into the pressing rollers is improved, and conveying efficiency is improved when conveying a sheet bundle upward obliquely, in particular, which, therefore, is effective for reduction of a floor space of a sheet finisher.

(7) By employing a driving means of a rotary motion type to drive a protruding plate, it is possible to make the driving to be smooth and to make the driving means to be simple.

(8) Desired digital processing is conducted by an image forming apparatus such as a copying machine, a printer, a facsimile machine or a hybrid machine thereof, and a recording sheet ejected out of the image forming apparatus is subjected to correct operations in processing modes for midway stapling, folding and paginating.

What is claimed is:

1. A sheet finisher comprising:

(a) a sheet stacking section on which sheets are stacked;

(b) a pair of folding rollers for pressing and conveying the sheets;

(c) a roller driving device for driving the pair of folding rollers;

(d) a protruding member which is protruded toward a nipping position of the pair of folding rollers to fold the sheets stacked on the sheet stacking section in two; and (e) a protruding member driving device for driving the protruding member to protrude toward the nipping position;

wherein when driving of the pair of folding rollers by the roller driving device is stopped, the protruding member driving device drives the protruding member toward the nipping position.

2. The sheet finisher of claim 1 wherein the roller driving device stops driving the pair of folding rollers at least until the protruding member is protruded to a farthest position thereof.

3. The sheet finisher of claim 2 wherein the roller driving device starts driving the pair of folding rollers when the protruding member is protruded to the farthest position thereof.

4. The sheet finisher of claim 2 wherein the roller driving device starts driving the pair of folding rollers after the protruding member passes through the nipping position to the farthest position, and then is brought back to a home position by the protruding member device.

5. The sheet finisher of claim 1 wherein a one-way clutch is located between each of the pair of folding rollers and the roller driving device, and when the protruding member is protruded, the pair of folding rollers is rotated by the force of an insertion operation of the sheets.

6. The sheet finisher of claim 1 wherein the sheets are folded in two so that a center portion in a conveyance direction of the sheets shows substantially a folding line.

7. The sheet finisher of claim 1 further comprising a displacement mechanism for displacing each of the pair of folding roller according to thickness of the sheets.

8. The sheet finisher of claim 1 wherein the protruding member has a fulcrum at an end thereof in a direction perpendicular to a sheet conveyance direction, and the protruding member is driven by the protruding member driving device while being rotated.

9. The sheet finisher of claim 1 further comprising:

a second sheet stacking section provided upstream of the sheet stacking section in a sheet conveyance direction on which a plurality of sheets are stacked;

a conveyance means for conveying the sheets toward the second sheet stacking section;

a stapling device for stapling bundled sheets stacked on the second sheet stacking section;

a second conveyance means for conveying the sheets toward the sheet stacking section from the second sheet stacking section;

a pair of pressure rollers provided downstream of the pair of folding rollers in the sheet conveyance direction for pressing the sheets; and a sheet ejecting section to which the sheets folded in two are ejected.

10. The sheet finisher of claim 9 wherein the pair of pressure rollers has a first roller whose surface is made of hard material and a second roller whose surface is made of resilient material.

11. The sheet finisher of claim 9 wherein each of the pair of folding rollers and each of the pair of pressure rollers is a drive roller.

12. The sheet finisher of claim 9 further comprising:

a first flat belt about which one of the pair of folding rollers and one of the pair of pressure rollers are trained, and a second flat belt about which the other of the pair of folding rollers and the other of the pair of pressure rollers are trained.

13. A sheet finisher comprising:

(a) a sheet stacking section on which sheets are stacked;

(b) a pair of folding rollers for pressing and conveying the sheets;

(c) a roller driving device for driving the pair of folding rollers;

(d) a displacement mechanism for symmetrically displacing each of the pair of folding roller with respect to a protruding member according to thickness of the sheet;

(e) the protruding member which is protruded toward a nipping position of the pair of folding rollers for folding the sheets stacked on the sheet stacking section in two;

(f) a protruding member driving device for driving the protruding member to protrude toward the nipping position; and (g) a stopping member for stopping each of the pair of folding rollers at a predetermined position so that outer circumferential surfaces of each of the pair of folding rollers may be close to each other or may come in contact slightly with each other.

14. The finisher of claim 13 wherein the displacement mechanism comprises:

arm members for pivotally supporting each of the pair of folding rollers;

an urging means provided on each of the arm members for bringing the pair of folding rollers into contact with each other, wherein each of the pair of folding rollers is returned to the predetermined position, when each of the arm members comes in contact with the stopping member.

15. The sheet finisher of claim 13 wherein a one-way clutch is located between each of the pair of folding rollers and the roller driving device, and when the protruding member is protruded, the pair of folding rollers is rotated by the force of an insertion operation of the sheets.

16. The sheet finisher of claim 13 further comprising:

a second sheet stacking section provided upstream of the sheet stacking section in a sheet conveyance direction on which a plurality of sheets are stacked;

a conveyance means for conveying the sheets toward the second sheet stacking section;

a stapling device for stapling bundled sheets stacked on the second sheet stacking section;

a second conveyance means for conveying the sheets toward the sheet stacking section from the second sheet stacking section;

a pair of pressure rollers provided downstream of the pair of folding rollers in the sheet conveyance direction for pressing the sheets; and a sheet ejecting section to which the sheets folded in two are ejected.

17. A sheet finisher comprising:

(a) a sheet stacking section on which sheets are stacked;

(b) a pair of folding rollers for pressing and conveying the sheets;

(c) a roller driving device for driving the pair of folding rollers;

(d) a displacement mechanism for displacing each of the pair or folding rollers according to thickness of the sheets;

(e) a protruding member which is protruded toward a nipping position of the pair of folding rollers for folding the sheets stacked on the sheet stacking section in two;

(f) a protruding member driving device for driving the protruding member toward the nipping position; and (g) a stopping member for stopping each of the pair of folding rollers at a predetermined position so that outer circumferential surfaces of each of the pair of folding rollers may be close to each other or may come slightly into contact with each other, wherein when the protruding member driving device drives the protruding member toward the nipping position, the pair of folding rollers is not rotated by the roller driving device.

18. The sheet finisher of claim 13 wherein, when the protruding member driving device drives the protruding member toward the nipping position, the pair of folding rollers is not rotated by the roller driving device.

* * * * *